United States Patent [19]

Ono et al.

[11] Patent Number: 5,032,487

[45] Date of Patent: Jul. 16, 1991

[54] COLOR LIGHT-SENSITIVE MATERIAL

[75] Inventors: Michio Ono; Masuzi Motoki; Hiroyuki Hirai, all of Kanagawa, Japan

[73] Assignee: Fuji Photo Film Co., Ltd., Kanagawa, Japan

[21] Appl. No.: 489,637

[22] Filed: Mar. 7, 1990

[30] Foreign Application Priority Data

Mar. 7, 1989 [JP] Japan ..... 1-54251

[51] Int. Cl.[5] ..... G03C 8/00; G03C 8/10

[52] U.S. Cl. ..... 430/218; 430/223; 430/441; 430/485; 430/559; 430/566

[58] Field of Search ..... 450/218, 223, 441, 485, 450/566, 559

[56] References Cited

U.S. PATENT DOCUMENTS

| | | | |
|---|---|---|---|
| 4,139,379 | 2/1979 | Chasman et al. | 430/223 |
| 4,139,389 | 2/1979 | Hinshaw et al. | 430/223 |
| 4,232,107 | 11/1980 | Janssens | 430/223 |
| 4,366,236 | 12/1982 | Takahashi et al. | 430/505 |
| 4,732,845 | 3/1988 | Keiji et al. | 430/551 |

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A color light-sensitive material comprising at least light-sensitive silver halide, a binder, a reducible dye providing compound and a reducing agent represented by the following formula (I).

(I)

wherein $R^1$ and $R^2$ each represents a hydrogen atom, a halogen atom, an alkyl group, an aryl group, an acylamino group, an alkoxy group, an aryloxy group, an alkylthio group, an arylthio group, an acyl group, a sulfonyl group, a carbamoyl group or a sulfamoyl group, or $R^1$ and $R^2$ may be combined together to form a carbon ring or a heterocyclic ring; $R^3$ represents an alkylene group; $R^4$, $R^5$, $R^6$ and $R^7$ each represents a hydrogen atom, a halogen atom, a hydroxyl group, a cyano group, a nitro group, an alkyl group, an acylamino group, a sulfonamido group, an alkoxy group, an aryloxy group, an alkylthio group, an arylthio group, an amino group, an acyl group, an acyloxy group, a carbamoyl group, a carbamoylamino group, a sulfamoyl group, a sulfamoylamino group, an alkoxycarbonyl group, an aryloxycarbonyl group, a heterocyclic group, an aryloxycarbonyloxy group; an alkoxysulfonyl group or an aryloxysulfonyl group (with the proviso that $R^5$ is not a hydroxyl group), or two adjoining groups may be combined together to form a carbon ring or a heterocyclic ring; X represents —NHCO—, —NHCONH—, —CONH—, —$NHSO_2$—, —$NHSO_2NH$— —$SO_2NH$— or $$-O-\overset{O}{\overset{\|}{C}}-;$$

m and n each represents 0 or 1; and the sum total of carbon atoms of $R^1$ to $R^7$ is not less than 8.

14 Claims, No Drawings

COLOR LIGHT-SENSITIVE MATERIAL

FIELD OF THE INVENTION

This invention relates to a color light-sensitive material, and more particularly to a color light-sensitive material which gives a positive color image having a high density and good color reproducibility and is excellent in raw stock-preservability.

BACKGROUND OF THE INVENTION

Many methods for obtaining a positive color image by a diffusion transfer process have been proposed.

For example, U.S. Pat. Nos. 4,559,290, 4,356,249 and 4,358,525, JP-A-53-35533 (the term "JP-A" as used herein means an "unexamined published Japanese patent application"), JP-A 53-110827, JP-A-54-130927, JP-A-56-164342, JP-A-59-154445 and JP-A-62-215270 disclose methods wherein dye-providing compounds which are oxidation type compounds incapable of releasing any dye are allowed to coexist with reducing agents or precursors thereof, the reducing agents are oxidized according to the exposure amount of silver halide by wet development or heat development, and reduction is carried out by the reducing agents which are left behind without being oxidized to release diffusible dyes. Further, EP-A-220746 and Kokai Giho 87-6199 (Vol. 12, No. 22) disclose color light-sensitive materials containing non-diffusible compounds which release diffusible dyes by the reductive cleavage of an N-X bond (wherein X is an oxygen, a nitrogen or a sulfur atom).

However, when the reducible dye-providing compounds together with the reducing agents or precursors thereof are used in combination with silver halide emulsions, problems occur in that the dye image is highly stained and raw stock-preservability is poor.

The use of diffusible electron transferring agents in addition to non-diffusible electron donors as reducing agents is effective in preventing a positive image from being stained in light-sensitive materials for forming a positive image containing reducible dye-providing compounds. However, the electron transferring agent radicals formed are diffused in other layers having different color sensitivity, and the electron donors contained in the layers are cross-oxidized by the radicals. Therefore, image density is lowered and color reproduction is deteriorated. Attempts have been made to provide an intermediate layer between light-sensitive layers having different color sensitivity from each other, or to incorporate a reducing substance in the intermediate layer. However, the amounts of binder and reducing substance to be added to each layer are limited to a certain range from the viewpoints of image-forming rate, resolution, layer quality, etc. in diffusion transfer type light-sensitive materials a in the present invention. Accordingly, a further improvement is demanded.

SUMMARY OF THE INVENTION

The first object of the present invention is to make an improvement in the raw stock-preservability of color light-sensitive materials containing reducible dye-providing compounds.

The second object of the present invention is to increase the image density of the light-sensitive materials and to make an improvement in the color reproducibility thereof.

The above objects of the present invention have been achieved by providing a color light-sensitive material comprising at least a light-sensitive silver halide, a binder, a reducible dye-providing compound and a reducing agent on a support, wherein the reducing agent is a compound represented by the following formula (I).

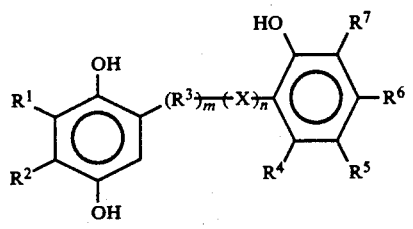

(I)

In formula (I), $R^1$ and $R^2$ each represents a hydrogen atom, a halogen atom, a substituted or unsubstituted alkyl group, a substituted or unsubstituted aryl group, a substituted or unsubstituted acylamino group, a substituted or unsubstituted alkoxy group, a substituted or unsubstituted aryloxy group, a substituted or unsubstituted alkylthio group, a substituted or unsubstituted arylthio group, a substituted or unsubstituted acyl group, a substituted or unsubstituted sulfonyl group, a substituted or unsubstituted carbamoyl group or a substituted or unsubstituted sulfamoyl group, or $R^1$ and $R^2$ may be combined together to form a carbon ring or a heterocyclic ring; $R^3$ represents a substituted or unsubstituted alkylene group; $R^4$, $R^5$, $R^6$ and $R^7$ each represents a hydrogen atom, a halogen atom, a hydroxyl group, a cyano group, a nitro group, a substituted or unsubstituted alkyl group, a substituted or unsubstituted acylamino group, a substituted or unsubstituted sulfonamido group, a substituted or unsubstituted alkoxy group, a substituted or unsubstituted aryloxy group, a substituted or unsubstituted alkylthio group, a substituted or unsubstituted arylthio group, a substituted or unsubstituted amino group, a substituted or unsubstituted acyl group, a substituted or unsubstituted acyloxy group, a substituted or unsubstituted carbamoyl group, a substituted or unsubstituted carbamoylamino group, a substituted or unsubstituted sulfamoyl group, a substituted or unsubstituted sulfamoylamino group, a substituted or unsubstituted alkoxycarbonyl group, a substituted or unsubstituted aryloxycarbonyl group, a substituted or unsubstituted heterocyclic group, a substituted or unsubstituted aryloxycarbonyloxy group, a substituted or unsubstituted alkoxysulfonyl group or a substituted or unsubstituted aryloxysulfonyl group (with the proviso that $R^5$ is not a hydroxyl group), or two adjoining groups may be combined together to form a carbon ring or a heterocyclic ring; X represents —NHCO—, —NHCONH—, —CONH—, $NHSO_2$—, —NH-$SO_2NH$—, —$SO_2NH$— or $$-O-\overset{\overset{\displaystyle O}{\|}}{C}-;$$

and m and n are independently 0 or 1. Further, the sum total of carbon atoms of $R^1$ to $R^7$ is not less than 8.

DETAILED DESCRIPTION OF THE INVENTION

Now, the present invention will be illustrated in more detail below.

In formula (I), $R^1$ and $R^2$ are each a hydrogen atom, a halogen atom (e.g., chlorine, bromine, fluorine), a substituted or unsubstituted alkyl group (having from 1 to 60 carbon atoms, e.g., methyl, t-butyl, t-octyl, cyclohexyl, n-hexadecyl, 3-decanamidopropyl, 1,1-dimethylbenzyl, phenethyl), a substituted or unsubstituted aryl group (having from 6 to 60 carbon atoms, e.g., phenyl, p-tolyl), a substituted or unsubstituted acylamino group (having from 2 to 60 carbon atoms, e.g., acetylamino, n-butaneamido, 2-hexyldecaneamido, 2-(2',4'-di-t-amylphenoxy)butaneamido, benzoylamino), a substituted or unsubstituted alkoxy group (having from 1 to 60 carbon atoms, e.g., methoxy, ethoxy, butoxy, n-octyloxy, methoxyethoxy), a substituted or unsubstituted aryloxy group (having from 6 to 60 carbon atoms, e.g., phenoxy, 4-t-octylphenoxy), a substituted or unsubstituted alkylthio group (having from 1 to 60 carbon atoms, e.g., butylthio, hexadecylthio), a substituted or unsubstituted arylthio group (having from 6 to 60 carbon atoms, e.g., phenylthio, 4-dodecyloxyphenylthio), a substituted or unsubstituted acyl group (having from 2 to 60 carbon atoms, e.g., acetyl, benzoyl, lauroyl), a substituted or unsubstituted sulfonyl group (having from 1 to 60 carbon atoms, e.g., methanesulfonyl, octanesulfonyl, benzenesulfonyl, dodecylbenzenesulfonyl), a substituted or unsubstituted carbamoyl group (having from 1 to 60 carbon atoms, e.g., N,N-dioctylcarbamoyl) or a substituted or unsubstituted sulfamoyl (having 0 to 60 carbon atoms, e.g., t-butylsulfamoyl), or $R^1$ and $R^2$ may be combined together to form a carbon ring or a heterocyclic ring.

When $R^1$ and $R^2$ are combined together to form a carbon ring or a heterocyclic ring, these rings are represented by *—Q—*, wherein Q represents an atomic group necessary to form a carbon ring or a heterocyclic ring together with carbon atoms to which $R^1$ and $R^2$ were bonded, and * represents a position where $R^1$ or $R^2$ was bonded. Q is a divalent group, and the examples thereof include an alkylene group, an amido bond, a divalent amino group, an ether bond, a thioether bond, an imino bond, a sulfonyl group and a carbonyl group, and a combination thereof. These divalent groups each may further have substituent(s). The carbon ring or the heterocyclic ring is preferably a 5- to 8-membered ring. The specific examples of the *—Q—* include:

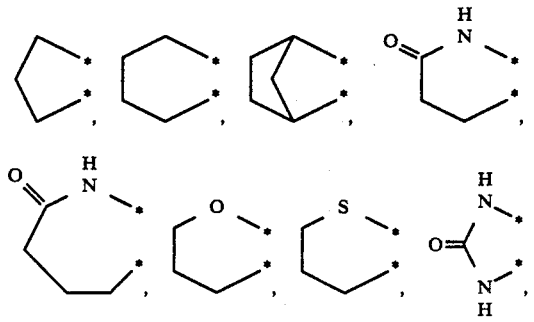

-continued

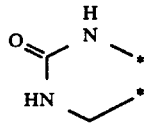

and

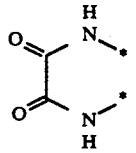

, which may further have substituent(s).

$R^3$ is a substituted or unsubstituted alkylene group (having from 1 to 5 carbon atoms, e.g., methylene, ethylene). Examples of substituent groups for the alkylene group are those already described above in the definition of $R^1$ and $R^2$ except a hydrogen atom.

$R^4$, $R^5$, $R^6$ and $R^7$ are each a hydrogen atom, a halogen atom (e.g., chlorine, bromine, fluorine), a hydroxyl group, a cyano group, a nitro group, a substituted or unsubstituted alkyl group (having from 1 to 60 carbon atoms, e.g., cyclohexyl, dodecyl, octadecyl, 3-(N,N-dihexylcarbamoyl)propyl), a substituted or unsubstituted acylamino group (having from 2 to 60 carbon atoms, e.g., octanoylamino, 2-hexyldecanoylamino, benzoylamino, nicotamido), a substituted or unsubstituted sulfonamido group (having from 1 to 60 carbon atoms, e.g., hexadecane sulfonamido, dodecyloxybenzenesulfonamido), a substituted or unsubstituted alkoxy group (having from 1 to 60 carbon atoms, e.g., methoxy, n-butoxy, hexadecyloxy, 2-methoxyethoxy), a substituted or unsubstituted aryloxy group (having from 6 to 60 carbon atoms, e.g., phenoxy, 4-t-octylphenoxy), a substituted or unsubstituted alkylthio group (having from 1 to 60 carbon atoms, e.g., methylthio), a substituted or unsubstituted arylthio group (having from 6 to 60 carbon atoms, e.g., phenylthio), a substituted or unsubstituted amino group (having from 0 to 60 carbon atoms, e.g., —$NH_2$, N,N-diethylamino, N,N-dioctadecylamino), a substituted or unsubstituted acyl group (having from 2 to 60 carbon atoms, e.g., acetyl, benzoyl, lauroyl), a substituted or unsubstituted acyloxy group (having from 2 to 60 carbon atoms, e.g., acetyloxy, benzoyloxy, lauroyloxy), a substituted or unsubstituted carbamoyl group (having from 1 to 60 carbon atoms, e.g., N,N-dicyclohexylcarbamoyl, N,N-dioctylcarbamoyl), a substituted or unsubstituted carbamoylamino group (having from 1 to 60 carbon atoms, e.g., N'-dodecylcarbamoylamino), a substituted or unsubstituted sulfamoyl group (having from 0 to 60 carbon atoms, e.g., N,N-dibutylsulfamoyl), a substituted or unsubstituted sulfamoylamino group (having from 0 to 60 carbon atoms, e.g., N',N'-dipropylsulfamoylamino), a substituted or unsubstituted alkoxycarbonyl group (having from 2 to 60 carbon atoms, e.g., methoxycarbonyl, butoxycarbonyl), a substituted or unsubstituted aryloxycarbonyl group (having from 7 to 60 carbon atoms, e.g., phenoxycarbonyl), a substituted or unsubstituted heterocyclic group (e.g., a 5-membered or 6-membered ring which may optionally have a condensed ring, which has from 1 to 60 carbon atoms such as octadecylsuccinimido, furyl, pyridyl), a substituted or unsubstituted aryloxycarbonyloxy group (having from 7 to 60 carbon atoms, e.g., phenoxycarbonyloxy), a substituted or unsubstituted alkoxysulfonyl group (having from 1 to 60 carbon atoms, e.g., methoxysulfonyl, ethoxysulfonyl) or a substituted or unsubstituted aryloxysulfonyl group (having from 6 to 60 carbon atoms, e.g., phenoxysulfonyl), or two adjoining groups may be combined together to form a carbon ring or a heterocyclic ring, with the proviso that $R^5$ is never represented by a hydroxyl group.

When two adjoining groups selected from $R^4$, $R^5$, $R^6$ and $R^7$ are combined together to form a carbon ring or a heterocyclic ring, the examples of the carbon ring or the heterocyclic ring include those which are formed by combining $R^1$ and $R^2$ together, as described above.

X is —NHCO—, —NHCONH—, —CONH—, —$NHCO_2$—, —$NHSO_2NH$—, —$SO_2NH$— or $$-O-\overset{\overset{\displaystyle O}{\|}}{C}-;$$

and m and n are independently 0 or 1.

The sum total of carbon atoms of $R^1$ to $R^7$ is at least 8.

The compounds of formula (I) may be in the form of a bis-compound, a tris-compound or a polymer.

In formula (I), $R^1$ and $R^2$ are preferably each a hydrogen atom, a halogen atom, a substituted or unsubstituted alkyl group, a substituted or unsubstituted alkoxy group or a substituted or unsubstituted alkylthio group. Among these, the compounds where $R^1$ and $R^2$ are each a hydrogen atom, a halogen atom or a substituted or unsubstituted alkyl group are more preferred with a substituted or unsubstituted alkyl group being most preferred.

In formula (I), $R^3$ is preferably an unsubstituted or alkyl-substituted alkylene group.

In formula (I), $R^4$, $R^5$, $R^6$ and $R^7$ are preferably each a hydrogen atom, a substituted or unsubstituted alkyl group, a substituted or unsubstituted acylamino group, a substituted or unsubstituted sulfonamido group, a substituted or unsubstituted alkoxy group, a substituted or unsubstituted acyloxy group, a substituted or unsubstituted carbamoyl group, a substituted or unsubstituted sulfamoyl group, a substituted or unsubstituted alkoxycarbamoyl group or a substituted or unsubstituted alkoxysulfonyl group. Among these, the compounds where $R^4$, $R^5$, $R^6$ and $R^7$ are each a hydrogen atom, a substituted or unsubstituted alkyl group, a substituted or unsubstituted acylamino group, a substituted or unsubstituted sulfonamido group, a substituted or unsubstituted carbamoyl group, or a substituted or unsubstituted alkoxycarbonyl group, are more preferred.

Preferably, X is —NHCO—.

The sum of m and n is preferably not greater than 2, the case where m=1 is very preferred and the case where n=0 is relatively preferred.

In formula (I), the sum total of carbon atoms of $R^1$ to $R^7$ is preferably within the range from 10 to 30.

Examples of the compounds of formula (I) which are used in the present invention include, but are not limited to, the following compounds.

(1)

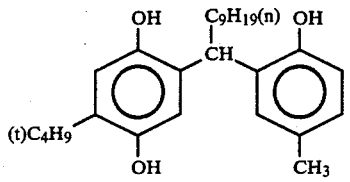

-continued (2)

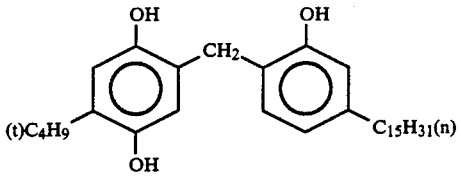

(3)

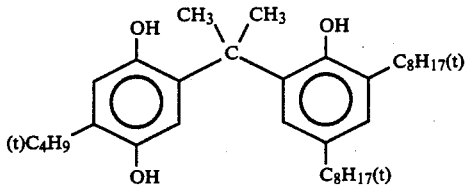

(4)

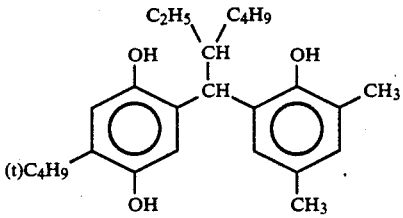

(5)

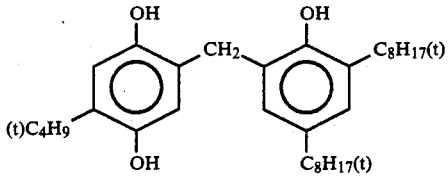

(6)

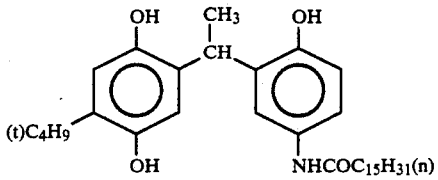

(7)

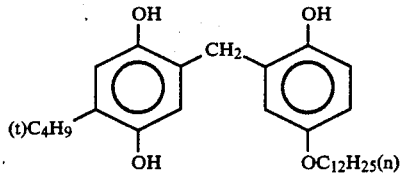

(8)

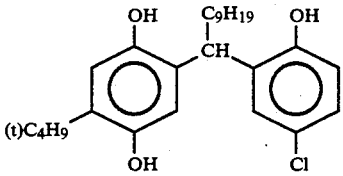

(9)

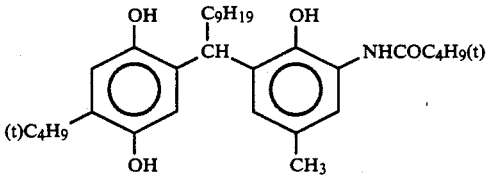

-continued
(10)
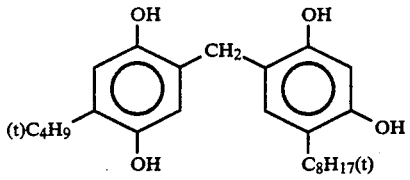
(11)
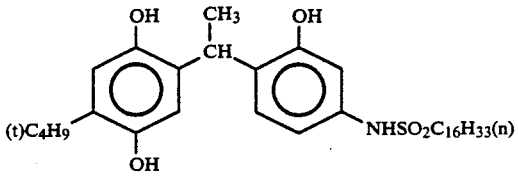
(12)
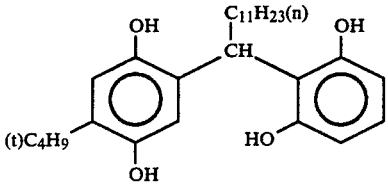
(13)
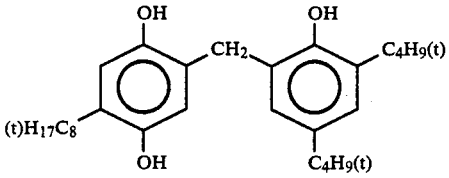
(14)
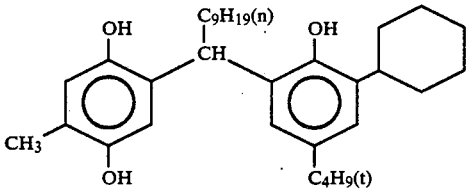
(15)
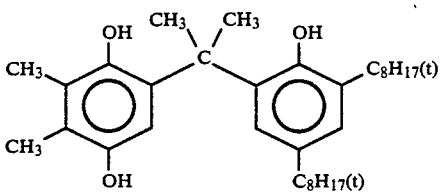
(16)
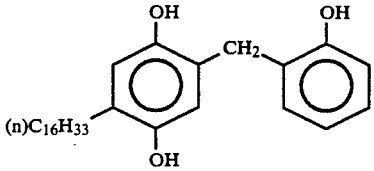
(17)
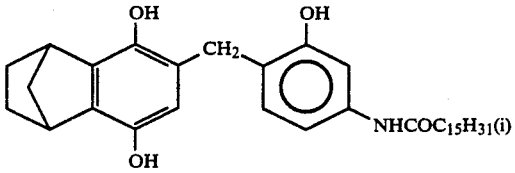
(18)
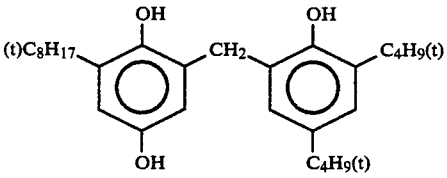
-continued
(19)
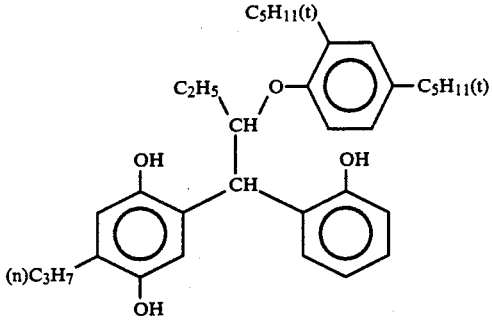
(20)
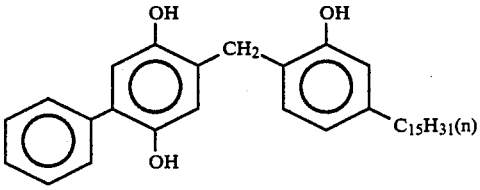
(21)
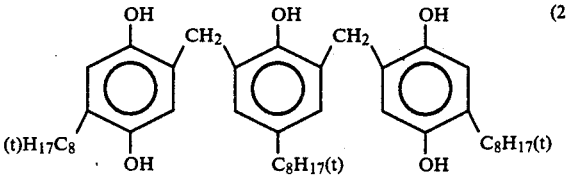
(22)
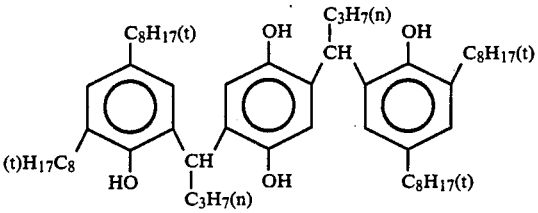
(23)
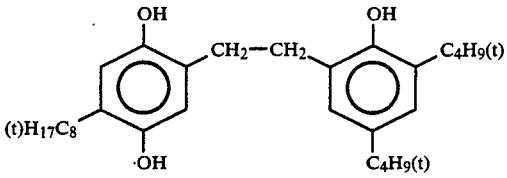
(24)
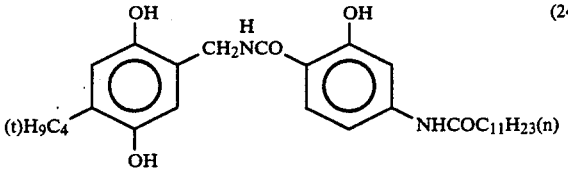
(25)
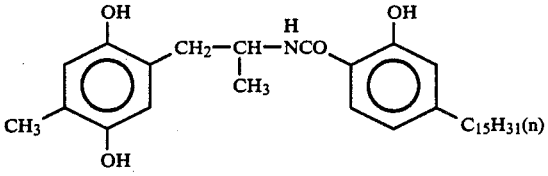
(26)
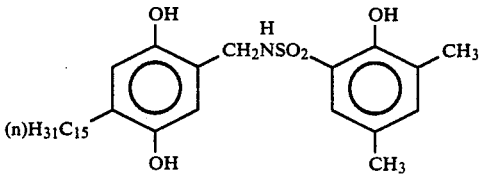

-continued (27)

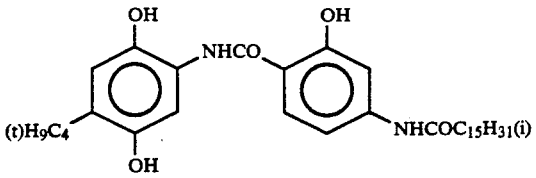

(28)

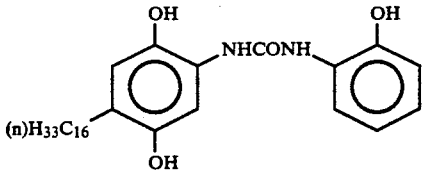

(29)

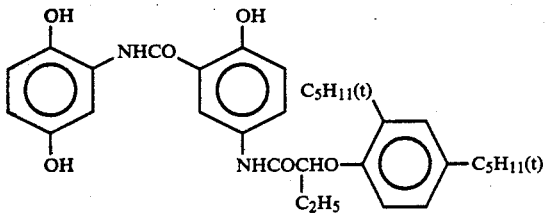

(30)

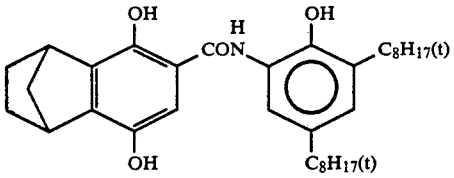

(31)

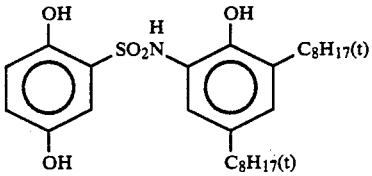

(32)

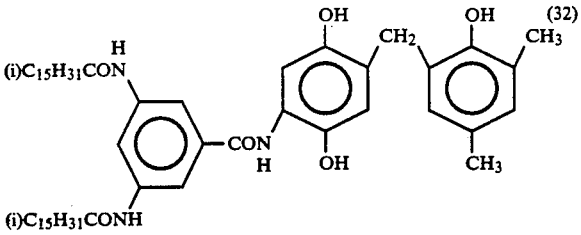

(33)

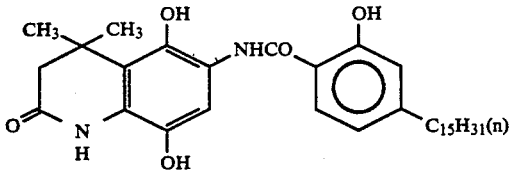

(34)

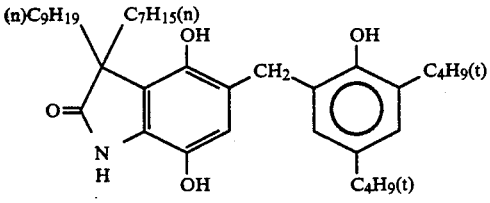

-continued (35)

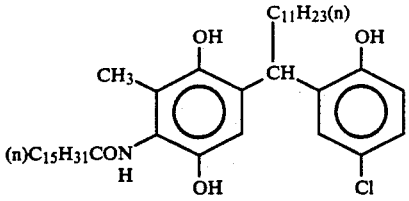

(36)

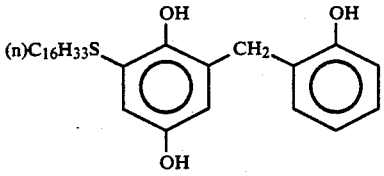

(37)

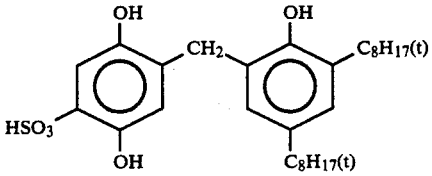

(38)

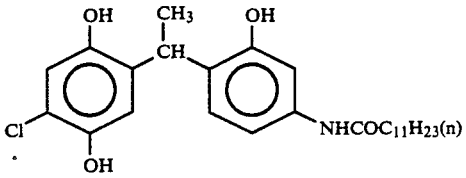

(39)

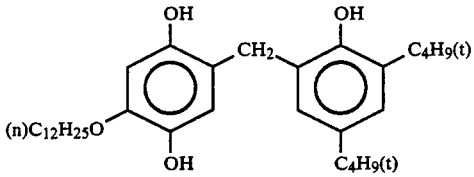

(40)

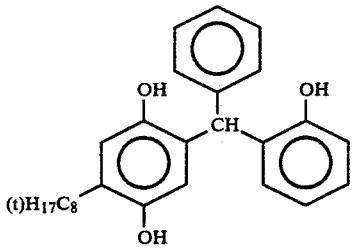

(41)

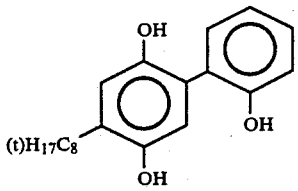

The following synthesis examples illustrate the typical preparation of the compounds of formula (I) of the present invention.

SYNTHESIS EXAMPLE 1

Synthesis of Exemplified Compound (1)

(1-1) 52.5 g of n-nonyl-2-hydroxy-5-methylphenylketone were dissolved in 100 ml of ethanol. A solution of 9.1 g of sodium boron hydride dissolved in 50 ml of water containing 1.1 g of sodium hydroxide was added dropwise thereto. The mixture was stirred at 40° C. for 2 hours. 100 ml of water was added thereto. Further, 20 ml of acetic acid was slowly added dropwise thereto. After the addition, the reaction mixture was extracted with ethyl acetate, and the organic layer was concentrated. 200 ml of hexane was added thereto, and the precipitated crystals were recovered by filtration to obtain 7.1 g of 2-(1'-hydroxydecyl)-4-methylphenol.

(1-2) 16 g of 2-(1'-hydroxydecyl)-4-methylphenol obtained above and 10 g of t-butylhydroquinone were dissolved in 50 ml of ethyl acetate. 3 ml of concentrated hydrochloric acid were added thereto, and the mixture was stirred at room temperature for 5 hours. The reaction mixture was introduced into 100 ml of water and extracted with ethyl acetate. The organic layer was concentrated and the resulting oily material was purified by means of silica gel column chromatography (chloroform/ethyl acetate=10/1) to obtain 11 g of the desired compound (1) as a white powder.

Elemental Analysis: Found C: 78.41% H: 10.01%, Calculated C: 78.60% H: 9.77%.

SYNTHESIS EXAMPLE 2

Synthesis of Exemplified Compound (2)

(2 1) 150 g of 3-pentadecylphenol and 17.7 g of paraformaldehyde were dispersed in 300 ml of water and 150 ml of methanol, and the dispersion was stirred at 50° C. for 12 hours. The reaction mixture was neutralized with concentrated hydrochloric acid and extracted with ethyl acetate. The extract was dried over anhydrous sodium sulfate and concentrated under reduced pressure. 300 ml of hexane were added to the residue to precipitate a crystal. The crystal was recovered by filtration and dried to obtain 32 g of 2-hydroxymethyl-5-pentadecylphenol.

(2-2) 8 g of the obtained 2-hydroxymethyl-5-pentadecylphenol and 4 g of tert-butylhydroquinone were dissolved in 50 ml of acetic acid. Two drops of concentrated sulfuric acid were added thereto at room temperature. The mixture was stirred for 4 hours. The reaction mixture was poured into 100 ml of water and extracted with ethyl acetate. The organic layer was dried over anhydrous sodium sulfate and concentrated under reduced pressure. The resulting oily material was purified by means of silica gel column chromatography (n-hexane/ethyl acetate=1/5) to obtain 3 g of the desired compound (2) as an oily matter.

Elemental Analysis: Found C: 79.39% H: 10.40%, Calculated C: 79.62% H: 10.44%.

SYNTHESIS EXAMPLE 3

Synthesis of Exemplified Compound (6)

(3-1) 21 g of 2-hydroxy-5-aminoacetophenone were dissolved in a mixture of 200 ml of acetonitrile, 100 ml of dimethylacetamide and 13.5 ml of pyridine. 28.7 g of hexadecanoyl chloride were added dropwise thereto at room temperature. After addition, the mixture was stirred for 1.5 hours. The reaction mixture was poured into 200 ml of water. The precipitated crystals were recovered by filtration and washed with acetonitrile. After drying, 40.5 g of 4-hexadecanoylamino-2-hydroxyacetophenone were obtained.

(3-2) 40 g of 4-hexadecanoylamino-2-hydroxyacetophenone obtained above were dispersed in 500 ml of ethanol. 4.3 g of sodium boron hydride were added thereto. The mixture was stirred at 40° C. for 1.5 hours. The reaction mixture was poured into 500 ml of water and weakly acidified with concentrated hydrochloric acid. The precipitated crystal was recovered by filtration and dried to obtain 26.7 g of 2-(1'-hydroxyethyl)-4-hexadecanoylaminophenol as a crystal.

(3-3) 24 g of 2-(1'-hydroxyethyl)-4-hexadecanoylaminophenol obtained above and 9.7 g of tert-butylhydroquinone were dispersed in 150 ml of ethyl acetate. 4.8 ml of concentrated sulfuric acid were added dropwise thereto at room temperature. The mixture was stirred at 35° C. for 1.5 hours. 200 ml of water were added to the reaction mixture. The organic layer was separated and washed with water. The solvent was distilled off under reduced pressure.

The residue was crystallized from 50 ml of ethyl acetate and 100 ml of n-hexane. The crystals were dried to obtain 15.3 g of the desired compound (6). Melting point: 160° to 161° C.

Elemental Analysis: Found C: 75.69% H: 9.81% N: 2.70%, Calculated C: 75.65% H: 9.90% N: 2.59%.

SYNTHESIS EXAMPLE 4

Synthesis of Exemplified Compound (13)

25.4 g of tert-octylhydroquinone and 27 g of 2-hydroxymethyl-4,6-di-tert-butylphenol were dissolved in 100 ml of acetic acid. 0.4 ml of concentrated sulfuric acid was added thereto at room temperature. The mixture was stirred at 40° C. for 4 hours. The reaction mixture was poured into 100 ml of cold water and extracted with ethyl acetate. The extract was dried over anhydrous sodium sulfate and concentrated under reduced pressure. The residue was crystallized from n-hexane. The crystal was dried to obtain 13.2 g of the desired compound (13). Melting point: 188° to 190° C.

Elemental Analysis: Found C: 79.10% H: 10.01%, Calculated C: 79.04% H: 10.06%.

The reducing agents of the present invention are used in an amount of 0.001 to 20 mol, particularly preferably 0.01 to 10 mol per mol of silver. The reducing agents are used in an amount of 0.05 to 10 mol, particularly preferably 0.1 to 5 mol per mol of the reducible dye-providing compound.

The reducing agents of the present invention may be used in combination with conventional reducing agents.

Examples of conventional reducing agents include reducing agents and precursors thereof described in U.S. Pat. Nos. 4,500,624 (columns 49 to 50), 4,483,914 (columns 30 to 31), 4,330,617 and 4,590,152, JP-A-60-140335 (pages 17 to 18), JP-A-57-40245, JP-A-56-138736, JP-A-59-178458, JP-A-59-53831, JP-A-59-182449, JP-A-59-182450, JP-A-60-119555, JP-A-60-128436 to JP-A-60-128439, JP-A-60-198540, JP-A-60-181742, JP-A-61-259253, JP-A-62-244044, JP-A-62-131253 to JP-A-62-131256 and EP-A-220746 (pages 78 to 96).

The reducing agents of the present invention are poor in diffusibility. Therefore, it is preferred that the reducing agents of the present invention are used in combination with electron transferring agents and/or precursors thereof to accelerate electron transfer between the reducing agent (electron donor) of the present invention and the developable silver halide.

It is desirable that the mobility of the electron transferring agent or its precursor is larger than that of the poorly diffusible reducing agent (electron donor). Particularly useful electron transferring agents include 1-phenyl-3-pyrazolidones, hydroquinones and aminophenols as described in U.S. Pat. No. 4,783,396.

Preferably, the combinations of the electron donors of the present invention with the electron transferring agents are incorporated in color light-sensitive materials. Two or more electron donors may be used in combination with two or more electron transferring agents or precursors thereof. The combinations may be added to each of the emulsion layers (blue-sensitive layer, green-sensitive layer, red-sensitive layer, infrared-sensitive layer, ultraviolet-sensitive layer, etc.) of the light-sensitive material. They may be added to part of the emulsion layers, layers (e.g., antihalation layer, subbing layer, intermediate layer, protective layer, etc.) adjacent to the emulsion layer, or all of the layers. The electron donor and the electron transferring agent may be added to the same layer. The reducing agent and the dye providing compound may be added to the same layer or separate layers. Preferably, the non-diffusible electron donor and the dye providing compound are allowed to co-exist in the same layer.

The electron transferring agents may be incorporated in an image receiving material (dye fixing layer). When solvents are used during development, the agents may be dissolved in said solvents.

When the oxidants of diffusible developing agents such as the electron transferring agents are diffused in layers having other hue, color reproducibility is deteriorated. Accordingly, the reducing agents of the present invention can be used not only for the reduction of the reducible dye providing compounds as described above, but also can be incorporated in the intermediate layer to allow them to function as scavengers for the oxidants of the diffusible developing agents to prevent color reproducibility from being deteriorated.

The reducible dye providing compounds which can be used in the light-sensitive materials of the present invention are described in U.S. Pat. No. 4,559,290, EP-A-220746, Kokai-Giho 87-6199, U.S. Pat. No. 4,783,396, etc., and are non-diffusible compounds which release diffusible dyes by the reaction with reducing agents left behind without being oxidized by development.

Examples of the reducible dye providing compounds include compounds which release diffusible dyes by intramolecular nucleophilic substitution reaction after reduction as described in U.S. Pat. Nos. 4,139,389 and 4,139,379, JP-A-59-185333 and JP-A-57-84453; compounds which release diffusible dyes by intramolecule electron transfer reaction after reduction as described in U.S. Pat. No. 4,232,107, JP-A-59-101649, JP-A-61-88257 and RD 24025 (1984); compounds which release diffusible dyes by the cleavage of a single bond after reduction as described in West German Patent 3,008,588A, JP-A-56-142530, U.S. Pat. Nos. 4,343,893 and 4,619,884; nitro compounds which release diffusible dyes after electron acceptance as described in U.S. Pat. No. 4,450,223; and compounds which release diffusible dyes after electron acceptance as described in U.S. Pat. No. 4,609,610.

More preferred examples thereof include compounds having an N—X′ bond (wherein X′ is an oxygen, sulfur or nitrogen atom) and an electron attractive group per molecule described in EP-A-220746, Kokai-Giho 87-6199, U.S. Pat. No. 4,783,396, JP-A-63-201653 and JP-A-63-201654; compounds having a $SO_2$—X′ group (wherein X′ is as defined above) and an electron attractive group per molecule described in JP-A-64-26842; compounds having a PO—X′ bond (wherein X′ is as defined above) and an electron attractive group per molecule described in JP-A-63-271344; and compounds having a C—X″ bond (wherein X″ is X′ or —$SO_2$—) and an electron attractive group per molecule described in JP-A-63-271341. Further, compounds which release diffusible dyes by the cleavage of a single bond after reduction by a $\pi$ bond conjugated with an electron accepting group may be used as described in Japanese Patent Application Nos. 62-319989 and 62-320771 (corresponding to JP-A-1-161237 and JP-A-1-161342, respectively.).

Among these, the compounds having an N—X′ bond and an electron attractive group per molecule are preferred. Concrete examples thereof include compounds (1) to (3), (7) to (10), (12), (13), (15), (23) to (26), (31), (32), (35), (36), (40), (41), (44), (53) to (59), (64) and (70) described in EP-A-220746; and the compounds (11) to (23) described in Kokai-Giho 87-6199.

Hydrophobic additives such as dye providing compounds and the non-diffusible reducing agents of the present invention can be introduced into the layers of the light-sensitive elements by conventional methods such as the method described in U.S. Pat. No. 2,322,027. In the introduction thereof into the layers, high-boiling organic solvents described in JP-A-59-83154, JP-A-59-178451, JP-A-59-178452, JP-A-59-178453, JP-A-59-178454, JP-A-59 178455 and JP-A-59-178457 can be used optionally in combination with low-boiling organic solvents having a boiling point of 50° to 160° C. Compounds having a viscosity of at least 50 cp at 25° C. and a dielectric constant of not higher than 10 are preferred as the high-boiling organic solvents. Examples thereof include the following compounds.

| | Viscosity (cp) | Dielectric Constant |
|---|---|---|
| $(n\text{-}C_{14}H_{29}O)_3P{=}O$ | 189 | 4.01 |
| 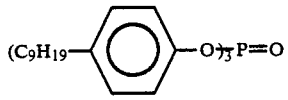 | 15600 | 5.08 |
| 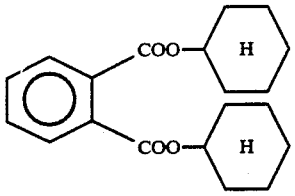 | solid | 6.45 (super-cooled liquid) |
| 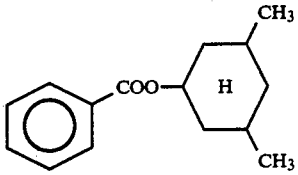 | solid | 5.32 (super-cooled liquid) |
| 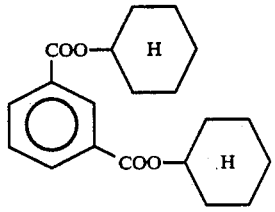 | 10700 | 5.84 |

-continued

| | Viscosity (cp) | Dielectric Constant |
|---|---|---|
| $HO-C(CH_2COOC_{13}H_{27}(iso))_3$ | 390 | 4.12 |

The amount of the reducible dye providing compound used varies depending on the extinction coefficient of a dye formed, but it usually are within the range from 0.05 to 5 mmol/m$^2$, preferably within the range from 0.1 to 3 mmol/m$^2$.

The high-boiling organic solvents are used in an amount of not more than 10 g, preferably not more than 5 g per one gram of the dye providing compound, or the solvents are used in an amount of preferably not more than 1 ml, more preferably not more than 0.5 ml, particularly preferably not more than 0.3 ml per one gram of the binder.

Dispersion methods using polymers as described in JP-B-51-39853 (the term "JP-B" as used herein means an "examined Japanese patent publication") and JP-A 51-59943 can be used.

When compounds are substantially insoluble in water, the compounds in the form of fine particles can be incorporated in binders in addition to the above-described method.

Various surface active agents can be used when hydrophobic compounds are dispersed in a hydrophilic colloid. For example, surface active agents described in JP-A-59-157636 (pages 37 and 38) can be used.

The light-sensitive material of the present invention comprises basically a light-sensitive silver halide, a binder, a reducing agent, a reducible dye providing compound and a high-boiling organic solvent on a support. These components are often added to the same layer. However, they may be added to separate layers when they can be reacted. For example, when a colored dye providing compound is allowed to exist in a layer under the silver halide emulsion, lowering in sensitivity can be prevented. When the reducing agent is allowed to exist in the emulsion layers as well as the intermediate layers, color reproducibility is improved.

In order to obtain a wide range of color in a chromaticity diagram using the three primary colors of yellow, magenta and cyan, at least three silver halide emulsion layers each having sensitivity in a different spectral range are employed in combination. For example, a combination of a blue-sensitive layer, a green-sensitive layer and a red-sensitive layer and a combination of a green-sensitive layer, a red-sensitive layer and an infrared-sensitive layer are illustrated. These light-sensitive layers can be positioned according to various orders known for conventional type color light sensitive materials. Further, each of these light-sensitive layers may be divided into two or more layers, if desired.

The light-sensitive material of the present invention may have various subsidiary layers, for example, a protective layer, a subbing layer, an intermediate layer, a yellow filter layer, an antihalation layer, or a back layer.

The silver halide which can be used in the present invention may be any one of silver chloride, silver bromide, silver iodobromide, silver chlorobromide, silver chloroiodide, and silver chloroiodobromide.

The silver halide emulsion to be used in the present invention can be either a surface latent image type silver halide emulsion or an internal latent image type silver halide emulsion. The internal latent image type emulsion is employed as a direct reversal emulsion by combination with a nucleating agent or light fogging. The silver halide emulsion to be used in the present invention may be a so-called core/shell emulsion in which the surface thereof differs from the interior thereof in phase.

The silver halide emulsion can be a monodisperse emulsion or a polydisperse emulsion. Also, a mixture of two or more monodisperse emulsions can be employed. A particle size of silver halide grains is preferably from 0.1 to 2 μm, particularly from 0.2 to 1.5 μm. The crystal habit of silver halide particles may be any of cubic, octahedral, tetradecahedral or high aspect ratio tabular grains.

Suitable examples of silver halide emulsion which can be used are described, for example, in U.S. Pat. Nos. 4,500,626 (50th column) and 4,628,021, *Research Disclosure,* No. 17029 (June, 1978), and JP-A-62-253159.

The silver halide emulsion may be used unripened. However, it is normally chemically sensitized before use. The silver halide emulsion may be subjected to a sulfur sensitization process, a reduction sensitization process, and a noble metal sensitization process, singly or in combination as known as emulsion for conventional type light-sensitive materials. These chemical sensitization processes may be effected in the presence of a nitrogen-containing heterocyclic compound as described in JP-A-62-253159.

In the present invention, the amount of light-sensitive silver halide to be coated is in the range from 1 mg/m$^2$ to 10 g/m$^2$ in terms of silver.

When the present invention is applied to heat-developable color light-sensitive material, an organic metal salt may be employed as an oxidizing agent together with light-sensitive silver halide. Among the organic metal salts, organic silver salts are particularly preferred.

Examples of organic compounds which can be used to form the above-described organic silver salt oxidizing agent include benzotriazoles, fatty acids and other compounds as described, for example, in U.S. Pat. No. 4,500,626 (52nd column to 53rd column). Other useful examples of such organic compounds include silver salts of carboxylic acids containing an alkynyl group such as silver phenylpropiolate as described in JP-A-60-113235 and acetylene silver as described in JP-A-61-249044. Two or more organic silver salts may be used in combination.

These organic silver salts may be used in an amount of from 0.01 to 10 mol, preferably from 0.01 to 1 mol, per mol of light-sensitive silver halide. The total amount of light-sensitive silver halide and organic silver salt to be coated is preferably in the range from 50 mg to 10 g/m$^2$ in terms of silver.

In the present invention, various antifogging agents or photographic stabilizers may be used. Examples of such antifogging agents or photographic stabilizers used include azoles and azaindenes as described in *Research Disclosure,* No. 17643, pages 24 and 25 (December, 1978), carboxylic acids or phosphoric acids containing nitrogen as described in JP-A-59-168442, mercapto compounds and metal salts thereof as described in JP-A-59-111636, and acetylene compounds as described in JP-A-62-87957.

The silver halide to be used in the present invention may be spectrally sensitized with a methine dye or the like. Examples of such dyes used include cyanine dyes, merocyanine dyes, complex cyanine dyes, complex merocyanine dyes, halopolar cyanine dyes, hemicyanine dyes, styryl dyes and hemioxonol dyes.

Specific examples of such dyes include sensitizing dyes as described, for example, in U.S. Pat. No. 4,617,257, JP-A-59-180550, JP-A-60-140335, and *Research Disclosure,* No. 17029, pages 12 and 13 (June, 1978).

These sensitizing dyes may be used singly or in combination. Such a combination of sensitizing dyes is often used particularly for the purpose of supersensitization.

Besides such a sensitizing dye, the emulsion may contain a dye which has no spectral sensitizing effect itself but exhibits a supersensitizing effect or a compound which does not substantially absorb visible light but exhibits supersensitizing effect as described in U.S. Pat. No. 3,615,641, and Japanese Patent Application No. 61-226294 (corresponding to JP-A-63-23145).

The sensitizing dye may be added to the emulsion during, before or after chemical ripening. Alternatively, it may be before or after the formation of nuclei of the silver halide grains in accordance with U.S. Pat. Nos. 4,183,756 and 4,225,666.

The amount of the sensitizing dye added is normally in the range from $10^{-8}$ to $10^{-2}$ mol per mol of silver halide.

As binders of layers for constituting the light-sensitive material or dye fixing material, hydrophilic binders are preferably employed. Examples of such binders are described in JP-A-62-253159, pages 26 to 28. More specifically, transparent or translucent hydrophilic binders are preferred. Suitable examples of such binders include natural compounds such as proteins (for example, gelatin and gelatin derivatives) and polysaccharides (for example, cellulose derivatives, starch, gum arabic, dextran and pullulan), and synthetic polymer compounds (for example, polyvinyl alcohol, polyvinyl pyrrolidone and acrylamide polymers).

Further, highly water absorptive polymers, that is, homopolymers of vinyl monomer containing —COOM or —$SO_3M$ (M represents a hydrogen atom or an alkali metal) or copolymers composed of two or more of such vinyl monomers or composed of such a vinyl monomer and other vinyl monomer (for example, sodium methacrylate, ammonium methacrylate and Sumikagel L-5H manufactured by Sumitomo Chemical Co., Ltd.) as described, for example, in JP-A-62-245260 may be employed.

Two or more of these binders may be employed in combination.

When a system of conducting heat development together with supplying a slight amount of water is adopted, it becomes possible to absorb water rapidly using the above-described highly water absorptive polymer. Further, re-transfer of dyes from a dye fixing material to other materials after dye transfer can be prevented by incorporating the highly water absorptive polymer into a dye fixing layer or a protective layer thereof.

In the present invention, the amount of the binder to be coated is preferably 20 g or less, more preferably 10 g or less, particularly preferably 7 g or less, per square meter.

Into layers constituting the light-sensitive material or dye fixing material (including a back layer), various polymer latexes can be incorporated for the purpose of improving physical properties of layers such as increasing dimensional stability and preventing curling, blocking, cracking, or pressure sensitization or desensitization. Specifically, any of the polymer latexes as described, for example, in JP-A-62-245258, JP-A-62-136648 and JP-A-62-110066 may be employed. In particular, the cracking of a mordanting layer can be prevented using a polymer latex having a low glass transition point (40° C. or less) in the mordanting layer, and the curling is effectively prevented by adding a polymer latex having a high glass transition point to the back layer.

In the present invention, the light-sensitive material may contain a compound which serves to activate development as well as to stabilize images. Specific examples of such compounds which can be preferably used in the present invention are described in U.S. Pat. No. 4,500,626 (51st column to 52nd column).

In a system which employs diffusion transfer of dyes to form images, a dye fixing material is used together with a light-sensitive material. An embodiment in which a light-sensitive material and a dye fixing material are separately coated on two supports and an embodiment in which a light-sensitive material and a dye fixing material are coated on the same support can be employed.

For the relationship between the light-sensitive material and the dye fixing material, between the light-sensitive material and the support, and between the light-sensitive material and a white reflecting layer, those as described in U.S. Pat. No. 4,500,626 (57th column) can be applied to the present invention.

The dye fixing material which can be preferably used in the present invention comprises at least one layer containing a mordant and a binder. Mordants which can be used in the present invention include those known in the field of photography, and specific examples thereof are mordants as described, for example, in U.S. Pat. No. 4,500,626 (58th column to 59th column), JP-A-61-88256 (pages 32 to 41), JP-A-62-244043 and JP-A-62-244036. Further, dye receptive polymer compounds as described in U.S. Pat. No. 4,463,079 may be employed.

The dye fixing material may comprise a subsidiary layer, for example, a protective layer, a stripping layer and an anti-curling layer, if desired. Particularly, it is effective to provide a protective layer.

To the layers constituting the light-sensitive material and dye fixing material, plasticizers, slipping agents, and organic solvents having a high boiling point as improving agents for stripping property of the light-sensitive material and dye fixing material can be employed. Specific examples thereof are those as described, for example, in JP-A-62-253159 (page 25) and JP-A-62-245253.

Moreover, for the purpose described above, various silicone oils (any silicone oils including from dimethyl silicone oil to modified silicone oils obtained by introducing various organic groups to dimethylsiloxane) can be employed. Useful examples of the silicone oils are various modified silicone oils, particularly carboxy-modified silicone (trade name: X-22-3710) as described in *Modified Silicone Oil,* technical data, pages 6 to 18B published by Shin-Etsu Silicone Co. Further, silicone oils as described in JP-A-62-215953 and Japanese Patent Application No. 62-23687 (corresponding to JP-A-63-46449) are also effective.

In the light-sensitive material and dye fixing material, color fading preventing agents may be employed. Color fading preventing agents which can be used include antioxidants, ultraviolet light absorbing agents and certain kinds of metal complexes.

Suitable examples of antioxidants include chroman series compounds, coumaran series compounds, phenol series compounds (for example, hindered phenols), hydroquinone derivatives, hindered amine derivatives and spiroindan series compounds. Further, compounds as described in JP-A-61-159644 are also effective.

Suitable examples of ultraviolet light absorbing agents include benzotriazole series compounds (those as described in U.S. Pat. No. 3,533,794), 4-thiazolidone series compounds (those as described in U.S. Pat. No. 3,352,681), benzophenone series compounds (those as described in JP-A-46-2784), and compounds as described in JP-A-54-48535, JP-A-62-136641 and JP-A-61-88256. Further, ultraviolet light-absorptive polymers as described in JP-A-62-260152 are effective.

Suitable examples of metal complexes include compounds as described, for example, in U.S. Pat. Nos. 4,241,155, 4,245,018 (3rd column to 36th column), and 4,254,195 (3rd column to 8th column), JP-A-62-174741, JP-A-61-88256 (pages 27 to 29), Japanese Patent Application Nos. 62-234103 and 62-31096 (corresponding to JP-A-1-75568 and JP-A-63-199248, respectively), and Japanese Patent Application No. 62-230596.

Suitable examples of color fading preventing agents are described in JP-A-62-215272 (pages 125 to 137).

Color fading preventing agents for the purpose of preventing fading of transferred dyes in the dye fixing material can be previously incorporated into the dye fixing material or may be supplied to the dye fixing material from the outside, for example, from the light-sensitive material.

The above-described antioxidants, ultraviolet light absorbing agents and metal complexes may be used in combination.

In the light sensitive material and dye fixing material, there may be used brightening agents. It is particularly preferred to incorporate brightening agents into the dye fixing material or to supply them from the outside, for example, from the light-sensitive material. Suitable examples of brightening agents are described, for example, in K. Veenkataraman, *The Chemistry of Synthetic Dyes,* Vol. V, Chapter 8 and JP-A-61-143752. More specifically, preferred brightening agents include stilbene series compounds, coumarin series compounds, biphenyl series compounds, benzoxazolyl series compounds, naphthalimide series compounds, pyrazoline series compounds and carbostyryl series compounds.

The brightening agents may be employed in combination with the color fading preventing agents.

Suitable examples of hardening agents which can be used in the layers constituting the light-sensitive material or dye fixing material include those as described, for example, in U.S. Pat. No. 4,678,739 (41st column), JP-A-59-116655, JP-A-62-245261 and JP-A-61-18942. More specifically, aldehyde series hardeners (for example, formaldehyde), aziridine series hardeners, epoxy series hardeners (for example,

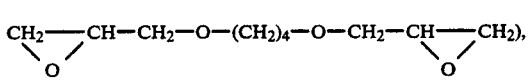

vinylsulfone series hardeners (for example, N,N'-ethylenebis(vinylsulfonylacetamido)ethane), N-methylol series hardeners (for example, dimethylolurea), and polymer hardeners (for example, compounds as described in JP-A-62-234157).

In the layers constituting the light-sensitive material and dye fixing material, various surface active agents are employed as coating aids or for other purposes, for example, improvement in stripping property, improvement in sliding property, antistatic property, and development acceleration. Specific examples of useful surface active agents are described, for example, in JP-A-62-173463 and JP-A-62-183457.

Into the layers constituting the light-sensitive material or and dye fixing material, organic fluoro compounds may be incorporated for the purpose of improvement in sliding property, antistatic property, and improvement in stripping property. Typical examples of the organic fluoro compounds include fluorine series surface active agents as described, for example, in JP-B-57-9053 (8th) column to 17th column), JP-A-61-20944 and JP-A-62-135826, oily fluorine series compounds such as fluoro oil, and hydrophobic fluorine compounds such as solid fluoro compound resins, for example, tetrafluoroethylene resin.

In the light-sensitive material and dye fixing material, matting agents can be used. Suitable examples of matting agents include silicon dioxide, compounds such as polyolefin and polymethacrylates as described in JP-A-61-88256 (page 29), as well as compounds such as benzoguanamine resin beads, polycarbonate resin beads and AS resin beads as described in Japanese Patent Application Nos. 62-110064 and 62-110065 (corresponding to JP-A-63-274944 and JP-A-63-274953, respectively).

Furthermore, into the layers constituting the light-sensitive material and dye fixing material, other additives, for example, heat solvents, defoaming agents, sterilizers, antimolds, and colloidal silica may be incorporated. Specific examples of these additives used are described in JP-A-61-88256 (pages 26 to 32).

In the light-sensitive material and/or dye fixing material according to the present invention, image formation accelerating agents can be employed. Such image formation accelerating agents serve to accelerate an oxidation reduction reaction of a silver salt oxidizing agent with a reducing agent, a reaction such as formation or decomposition of a dye or release of a diffusible dye from a dye providing compound, and migration of a dye from a light-sensitive material layer to a dye fixing layer. In the light of physicochemical function, image formation accelerating agents can be classified into bases or base precursors, nucleophilic compounds, organic solvents having a high boiling point (oils), heat solvents, surface active agents, and compounds capable of interacting with silver or silver ion. However, these substance groups generally have a composite function and thus a combination of the above-described accelerating effects. The details thereof are described in U.S. Pat. No. 4,678,739 (38th column to 40th column).

Examples of useful base precursors include salts of organic acids and bases which decompose by heating with decarboxylation, and compounds which release an amine upon decomposition with an intramolecular nucleophilic displacement reaction, a Lossen rearrangement reaction or a Beckmann rearrangement reaction. Specific examples thereof are described, for example, in U.S. Pat. No. 4,511,493 and JP-A-62-65038.

In a system wherein heat development and transfer of dye are simultaneously conducted in the presence of a small amount of water, it is preferred to incorporate a base and/or a base precursor into the dye fixing material from the standpoint of increasing preservability of the light-sensitive material.

In addition, combinations of sparingly soluble metal compounds and compounds (referred to as complex forming compounds) capable of forming a complex with a metal ion constituting the sparingly soluble metal compound as described in EP-A-210660, and compounds which generate a base upon electrolysis as described in JP-A-61-232451 can be employed as base precursors. Particularly, the former method is effective. It is advantageous that the sparingly soluble metal compound and the complex forming compound are added separately to the light-sensitive material and the dye fixing material.

In the light-sensitive material and/or dye fixing material to be used in the present invention, various development stopping agents can be used for the purpose of ensuring constant image quality regardless of any fluctuation in processing temperature and time during development.

The term "development stopping agent" as used herein means a compound which rapidly neutralizes or reacts with a base to decrease the base concentration in the layer so that development is stopped after proper development, or a compound which interacts with silver or silver salt to inhibit development after proper development. Specific examples of such development stopping agents include acid precursors which release an acid upon heating, electrophilic compounds which undergo a displacement reaction with a base present therewith upon heating, and nitrogen-containing heterocyclic compounds, mercapto compounds and precursors thereof. More specifically, those described in JP-A-62-253159 (pages 31 and 32) are employed.

Supports used in the light-sensitive material and dye fixing material according to the present invention are those which can endure the processing temperature. In general, paper and synthetic polymer films are employed. More specifically, films of polyethylene terephthalate, polycarbonate, polyvinyl chloride, polystyrene, polypropylene, polyimide and celluloses (for example, triacetyl cellulose) or those film containing pigment such as titanium oxide, synthetic paper produced from polypropylene, paper manufactured from a mixture of synthetic pulp such as polyethylene and natural pulp, Yankee paper, baryta paper, coated paper (particularly cast coated paper), metals, cloths, and glass are employed. These may be employed individually or as supports one or both surfaces of which are laminated with synthetic polymers such as polyethylene. Further, supports as described in JP-A-62-253159 (pages 29 to 31) are usable.

On the surface of the support, a mixture of a hydrophilic binder and a semiconductive metal oxide such as alumina sol and tin oxide, an antistatic agent such as carbon black may be coated.

In order to expose image for recording on the light-sensitive material, various methods can be utilized, for example, a method of direct photographing a landscape or portrait using a camera, a method of exposure through a reversal film or a negative film by means of a printer or an enlarger, a method of scanning exposure of an original through a slit using an exposure device of a copying machine, a method wherein image information is exposed upon light emission from a light emitting diode or various laser via electric signal, and a method wherein image information on an image display device, for example, CRT, liquid crystal display, electroluminescence display, or plasma display is exposed directly or through an optical system.

Light sources for recording image on the light sensitive material which can be used include those as described in U.S. Pat. No. 4,500,626 (56th column) such as natural light, tungsten lamps, light emitting diodes, laser light sources, and CRT light sources, as described above.

Furthermore, image exposure may be conducted using a wavelength conversion element composed of a combination of a nonlinear optical material and a coherent light source such as laser light. The nonlinear optical material is a material capable of generating nonlinearity between polarization and electric field which occurs when strong photoelectric field such as laser light is provided. Specific examples of the nonlinear optical materials which can be preferably used include inorganic compounds represented by, for example, lithium niobate, potassium dihydrogenphosphate (KDP), lithium iodate, or $BaB_2O_4$, urea derivatives, nitroaniline derivatives, nitropyridine-N-oxide derivatives such as 3-methyl-4-nitropyridine-N-oxide (POM), or compounds as described in JP-A-61-53462 and JP-A-62-210432. As the form of the wavelength conversion element, a single crystal light conducting wave guide type and a filter type are known, and they are effectively employed.

Moreover, the above-described image informations used include image signals obtained by a video camera or an electro still camera, television signals represented by Japan Television Signal Standard (NTSC), image signals obtained by dividing an original into many dots by means of a scanner, and image signals prepared by means of a computer represented by CG and CAD.

The light-sensitive material and/or dye fixing material may have an electroconductive heat-generating layer (heating element) as a heating means for heat development or diffusion transfer of dyes. As the heating element, transparent or opaque in this case, those as described in JP-A-61-145544 are utilizable. The electroconductive layer acts also as an antistatic layer.

The temperature of development and/or transfer is not lower than about 10° C. Preferably, heat development is carried out. The heating temperature required for the heat development step is ordinarily in the range from about 50° C. to about 250° C., and preferably from about 60° C. to about 180° C. The diffusion transfer step of dyes can be performed simultaneously with or after the heat development step. In the latter case, the transfer can be conducted at a temperature ranging from the temperature for the heat development to room temperature, particularly preferably at a temperature ranging from 50° C. to about 10° C. lower than the temperature at the heat development step.

The migration of dyes may occur only by heating, but an appropriate solvent may be employed in order to accelerate the transfer of dyes. Further, as described in detail in JP-A-59-218443 and JP-A-61-238056, a process in which a light-sensitive material is heated in the presence of a small amount of solvent, particularly water so that development and transfer are simultaneously or sequentially effected is useful. In such a process, the heating temperature is preferably in the range from 50° C. to not higher than the boiling point of the solvent used. For example, if the solvent is water, the suitable heating temperature is in the range from 50° C. to 100° C.

Examples of such a solvent which can be used to accelerate development and/or migrate diffusible dyes to the dye fixing layer include water, and a basic aqueous solution containing an inorganic alkali metal salt or an organic base as described with reference to the image formation accelerator. There can also be used a solvent having a low boiling point, or a mixture of a solvent having a low boiling point and water or a basic aqueous solution. Alternatively, a surface active agent, an antifogging agent, a sparingly soluble metallic salt, or a complex forming compound may be contained in the solvent.

These solvents may be imparted to either or both of the dye fixing material and the light-sensitive material. The amount of the solvent to be used may be as small as not more than the weight of the solvent of a volume equivalent to the maximum swelling volume of the entire coated film (particularly, not more than the value obtained by subtracting the weight of the entire coated film from the weight of the solvent of a volume equivalent to the maximum swelling volume of the entire coated film).

Methods for providing such a solvent to the light-sensitive layer or the dye fixing layer which can be used include those described in JP-A-61-147244 (page 26). Alternatively, the solvent may be previously incorporated into either the light-sensitive material or the dye fixing material or both of them in the form of microcapsule.

Furthermore, a system may be used in which a hydrophilic heat solvent which stays solid at normal temperature but melts at an elevated temperature is incorporated in the light-sensitive material or the dye fixing material in order to accelerate the migration of dyes. Such a hydrophilic heat solvent may be incorporated in either or both of the light-sensitive material and the dye fixing material. The layer in which the hydrophilic heat solvent is to be incorporated is any of the emulsion layer, intermediate layer, protective layer, and dye fixing layer, particularly the dye fixing layer and/or an adjacent layer thereto.

Examples of the hydrophilic heat solvent include ureas, pyridines, amides, sulfonamides, imides, alcohols, oximes, and other heterocyclic compounds.

Moreover, in order to accelerate the migration of dyes, an organic solvent having a high boiling point may be incorporated into the light-sensitive material and/or the dye fixing material.

Suitable heating methods for the development step and/or transfer step include to be contacted with a heated block or plate, a hot plate, a hot presser, a hot roller, a halogen lamp heater, or an infrared or far infrared lamp heater, or to be passed through a high temperature atmosphere.

The pressure condition and pressure application process to be used when the light-sensitive material and the dye fixing material are brought into close contact with each other are described in JP-A-61-147244 (page 27).

Processing of the photographic elements according to the present invention can be carried out by means of any of various heat development machines. Preferably used heat development machines include those described, for example, in JP-A-59-75247, JP-A-59-177547, JP-A-59-181353, JP-A-60-18951 and JP-A-U-62-25944 (the term "JP-A-U" as used herein means an "unexamined published Japanese utility model application").

The color light-sensitive materials of the present invention may be designed so that they are processed by a conventional wet color diffusion transfer process. In this case, the above-described light-sensitive materials and the above-described dye fixing materials can be used by omitting the additives (e.g., the organic silver salt) which are essential ingredients for heat development. The base or the electron transferring agent may be fed from processing solution enclosed in a rupturable container. Conventional tackifiers may be added to the processing solution. Color diffusion transfer processes are known in the photographic field and any of the conventional processes can be used in the present invention.

The present invention is now illustrated in greater detail with reference to the following examples which, however, are not to be construed as limiting the invention in any way.

Unless otherwise indicated, all percents, ratios, parts, etc., are by weight.

EXAMPLE 1

The emulsion (I) for the first layer was prepared in the following manner.

20 g of gelatin, 1 g of potassium bromide and 0.5 g of $OH(CH_2)_2S(CH_2)_2OH$ were added to 800 ml of water, and the resulting aqueous gelatin solution was kept at 50° C. and well-stirred. To the aqueous gelatin solution stirred, solutions (I), (II) and (III) were added simultaneously at an equal flow rate over a period of 30 minutes. In this way, a monodisperse silver bromide emulsion having a mean grain size of 0.42 μm and containing dyes adsorbed thereby was prepared.

After water washing and desalting, 20 g of lime-processed ossein gelatin was added thereto, the pH was adjusted to 6.4 and the pAg was adjusted to 8.2. The emulsion was kept at 60° C. 9 mg of sodium thiosulfate, 6 ml of a 0.01% aqueous solution of chloroauric acid and 190 mg of 4-hydroxy-6-methyl-1,3,3a,7-tetrazaindene were added thereto, and chemical sensitization was carried out for 45 minutes. Yield of the emulsion: 635 g.

| | Solution I (total volume of 450 ml by adding water) | Solution II (total volume of 400 ml by adding water) | Solution III (total volume of 60 ml by adding methanol) |
|---|---|---|---|
| $AgNO_3$ | 100 g | — | — |
| KBr | — | 70 g | — |
| Dye (a) | — | — | 40 mg |
| Dye (b) | — | — | 80 mg |

-continued

Dye (a)

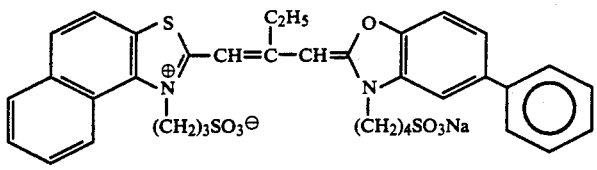

Dye (b)

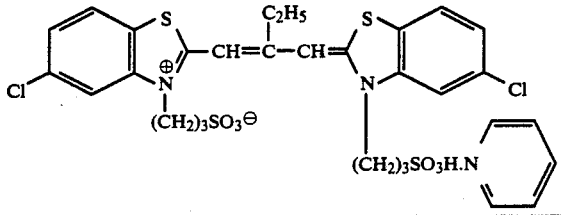

The emulsion (II) for the third layer was prepared in the following manner.

20 g of gelatin, 0.30 g of potassium bromide, 6 g of sodium chloride and 0.015 g of the following reagent A were added to 730 ml of water, and the resulting aqueous gelatin solution was kept at 60.0° C. and well-stirred. To the aqueous gelatin solution stirred, solutions (I') and (II') were added simultaneously at an equal flow rate over a period of 60 minutes. After the completion of the addition of solutions (I') and (II'), the methanol solution (III') of the sensitizing dye B was added thereto. In this way, a monodisperse cube emulsion having a mean grain size of 0.45 μm and containing the dye adsorbed thereon was prepared.

After water washing and desalting, 20 g of gelatin was added thereto, the pH was adjusted to 6.4 and the pAg was adjusted to 7.8. Chemical sensitization was then carried out at 60.0° C. Reagents used were 1.6 mg of triethylthiourea and 100 mg of 4-hydroxy-6-methyl-1,3,3a,7-tetrazaindene, and the ripening time was 55 minutes. Yield of emulsion: 635 g.

20 g of gelatin, 3 g of potassium bromide and 0.3 g of $HO(CH_2)_2S(CH_2)_2S(CH_2)_2OH$ were added to 800 ml of water, and the resulting aqueous gelatin solution was kept at 60° C. and vigorously stirred. To the aqueous gelatin solution stirred, solutions (I'') and (II'') were added simultaneously over a period of 30 minutes. Solutions (III'') and (IV'') were then added thereto simultaneously over a period of 20 minutes. After the beginning of addition of the solution (III''), a solution of dye C (0.14 g) dissolved in methanol (70 ml) was added thereto over a period of 5 to 18 minutes.

After water washing and desalting, 20 g of lime-processed ossein gelatin was added thereto, the pH was adjusted to 6.2 and the pAg was adjusted to 8.5. Sodium thiosulfate, 4-hydroxy-6-methyl-1,3,3a,7-tetrazaindene and chloroauric acid were then added thereto, and chemical sensitization was carried out. Thus, 600 g of a monodisperse octahedral silver iodobromide emulsion having a mean grain size of 0.45 μm was obtained.

Reagent A

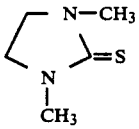

Sensitizing dye B

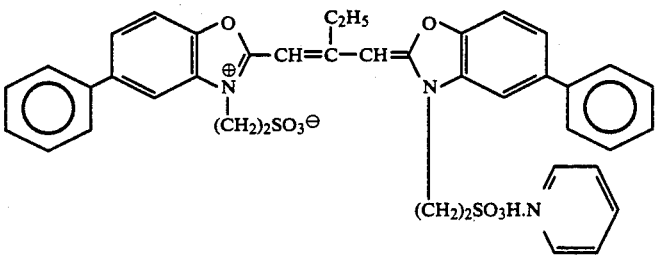

| | Solution I' (total volume of 400 ml by adding water) | Solution II' (total volume of 400 ml by adding water) | Solution III' (total volume of 77 ml by adding methanol) |
|---|---|---|---|
| $AgNO_3$ | 100.0 g | — | — |
| KBr | — | 56.0 g | — |
| NaCl | — | 7.2 g | — |
| Dye B | — | — | 0.23 g |

In the emulsion (III) for the fifth layer was prepared in the following manner.

| | Solution I'' (180 ml | Solution II'' (180 ml | Solution III'' (350 ml | Solution IV'' 350 ml |
|---|---|---|---|---|

-continued

| | by adding water) | by adding water) | by adding water) | by adding water) |
|---|---|---|---|---|
| $AgNO_3$ | 30 g | — | 70 g | — |
| KBr | — | 20 g | — | 49 g |
| KI | — | 1.8 g | — | — |

Dye C

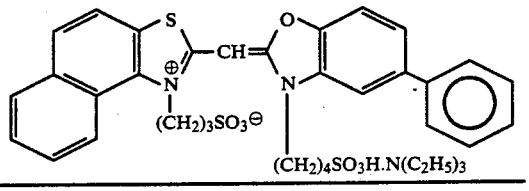

The gelatin dispersion of the dye providing compound was prepared in the following manner.

18 g of yellow dye providing compound (1)*, 9 g of electron donor (1)*, 0.6 g of electron transferring agent precursor (1)* and 13.5 g of tricyclohexyl phosphate were weighed. 46 ml of ethyl acetate was added thereto. The mixture was heated at about 60° C. to dissolve the mixture and thus obtain a uniform solution. To this solution, 100 g of a 10% solution of lime-processed gelatin, 60 ml of water and 1.5 g of sodium dodecylbenzenesulfonate were mixed with stirring. The mixture was dispersed at 10000 rpm in a homogenizer for 10 minutes. The dispersion was referred to as the dispersion of yellow dye providing compound.

In the same way as in the preparation of the dispersion of the yellow dye providing compound, the dispersion of the magenta dye providing compound and the dispersion of the cyan dye providing compound were prepared by using a magenta dye providing compound (2)* and a cyan dye providing compound (3)*, respectively in place of the yellow dye providing compound (1)*.

A light-sensitive material 101 having a structure given in Table 1 was prepared by using the emulsions obtained above.

TABLE 1

| Layer No. | Layer | Additive | Amount ($g/m^2$) |
|---|---|---|---|
| Sixth layer | protective layer | gelatin | 0.90 |
| | | Matting agent (silica) | 0.03 |
| | | water-soluble polymer (1)* | 0.02 |
| | | $Zn(OH)_2$ | 0.60 |
| | | surface active agent (1)* | 0.06 |
| | | surface active agent (2)* | 0.13 |
| | | hardening agent (1)* | 0.01 |
| Fifth layer | blue-sensitive layer | emulsion (III) (in terms of silver) | 0.33 |
| | | gelatin | 0.56 |
| | | anti-fogging agent (2)* | $5.5 \times 10^{-4}$ |
| | | yellow dye providing compound (1)* | 0.40 |
| | | electron transferring agent precursor (1)* | $1.3 \times 10^{-2}$ |
| | | high-boiling organic solvent (1)* | 0.30 |
| | | electron donor (1)* | 0.20 |
| | | surface active agent (3)* | 0.05 |
| Fifth layer | blue-sensitive layer | $Zn(OH)_2$ | 0.33 |
| | | hardening agent (1)* | 0.01 |
| | | water-soluble polymer (1)* | 0.02 |
| Fourth layer | intermediate layer | gelatin | 0.07 |
| | | $Zn(OH)_2$ | 0.31 |
| | | reducing agent (1)* | 0.14 |
| | | high-boiling organic solvent (1)* | 0.05 |
| | | surface active agent (3)* | $4.5 \times 10^{-3}$ |
| | | surface active agent (1)* | 0.02 |
| | | surface active agent (4)* | 0.07 |
| | | electron transferring agent (1)* | 0.03 |
| | | water-soluble polymer (1)* | 0.02 |
| | | hardening agent (1)* | 0.01 |
| Third layer | green-sensitive layer | emulsion (II) (in terms of silver) | 0.21 |
| | | gelatin | 0.29 |
| Third layer | green-sensitive layer | anti-foggant agent (1)* | $6.0 \times 10^{-4}$ |
| | | magenta dye providing compound (2)* | 0.31 |
| | | electron transferring agent precursor (1)* | $2.0 \times 10^{-2}$ |
| | | high-boiling organic solvent (1)* | 0.16 |
| | | electron donor (1)* | 0.12 |
| | | surface active agent (3)* | 0.04 |
| | | electron transferring agent (1)* | 0.03 |
| | | hardening agent (1)* | 0.01 |
| | | water-soluble polymer (1)* | 0.02 |
| Second layer | intermediate layer | gelatin | 0.80 |
| | | $Zn(OH)_2$ | 0.31 |
| | | reducing agent (1)* | 0.14 |
| | | high-boiling organic solvent (1)* | 0.05 |
| | | surface active agent (3)* | $4.5 \times 10^{-3}$ |
| | | surface active agent (1)* | 0.06 |
| Second layer | intermediate layer | surface active agent (4)* | 0.10 |
| | | water-soluble polymer (1)* | 0.03 |
| | | hardening agent (1)* | 0.01 |
| First layer | red-sensitive layer | emulsion (I) (in terms of silver) | 0.22 |
| | | gelatin | 0.30 |
| | | anti-foggant agent (1)* | $6.0 \times 10^{-4}$ |
| | | cyan dye providing compound (3)* | 0.28 |
| | | electron transferring agent precursor (1)* | $1.5 \times 10^{-2}$ |
| | | high-boiling organic solvent (1)* | 0.14 |
| | | electron donor (1)* | 0.12 |
| | | surface active agent (3)* | 0.04 |

TABLE 1-continued

| | | |
|---|---|---|
| | surface active agent (1)* | 0.03 |
| | hardening agent (1)* | 0.01 |
| | water-soluble polymer (1)* | 0.02 |
| Support (polyethylene terephthalate of 100 μm in thickness) | | |
| Back layer | carbon black | 0.44 |
| | polyester | 0.30 |
| | polyvinyl chloride | 0.30 |

Water-soluble polymer (1)*

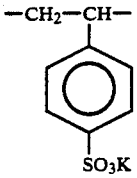

Surface active agent (1)*
Aerosol OT
Surface active agent (2)*

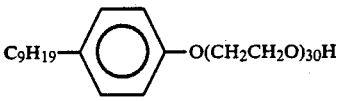

Surface active agent (3)*

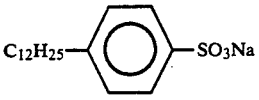

Surface active agent (4)*

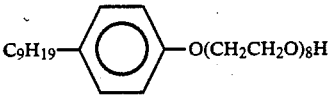

Hardening agent (1)*
1,2-Bis(vinylsulfonylacetamido)ethane
High-boiling organic solvent (1)*
Tricyclohexyl phosphate
Anti-fogging agent (1)*

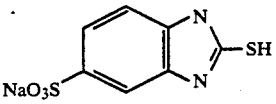

Anti-fogging agent (2)*

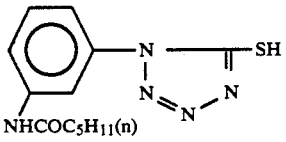

Reducing agent (1)*

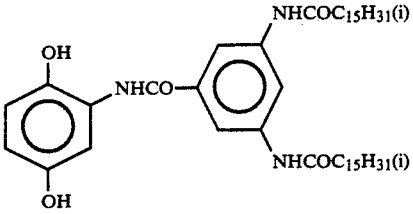

Electron donor (1)*

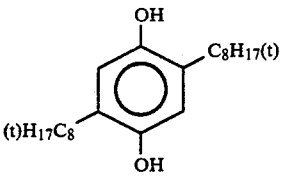

Electron transferring agent precursor (1)*

TABLE 1-continued

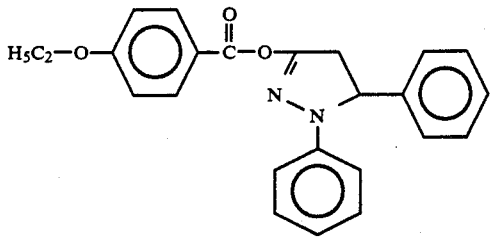

Electron transferring agent (1)*

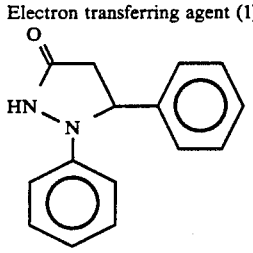

Yellow dye providing compound (1)*

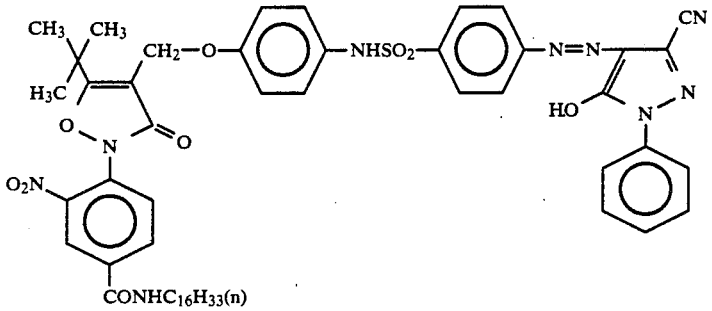

Magenta dye providing compound (2)*

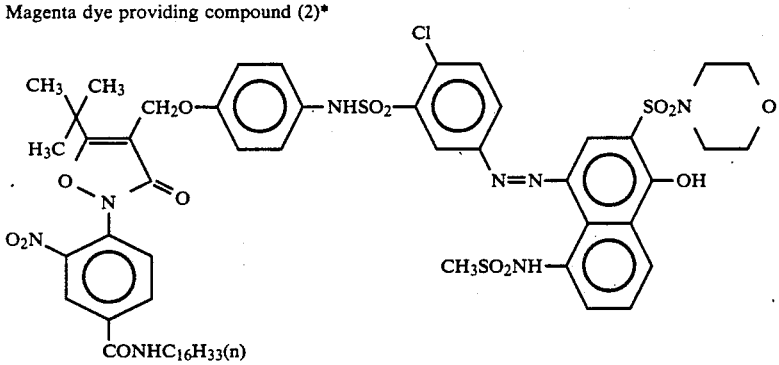

Cyan dye providing compound (3)*

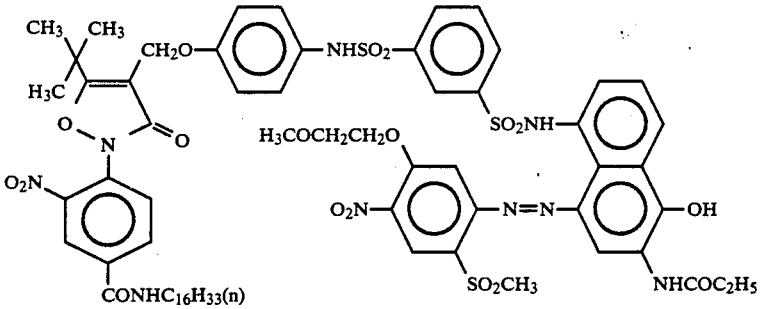

Light-Sensitive materials 102 to 105 were prepared in the same way as in the preparation of the light-sensitive material 101 except that an equimolar amount of each of the compounds of the present invention set forth in Table 2 was used in place of the electron donor (1)* in each of the first layer, the third layer and the fifth layer of the light-sensitive material 101.

The reducing agent (1)* was dispersed in the following manner and then added.

14 g of reducing agent (1)* and 5 g of high-boiling organic solvent (1)* were dissolved in 25 ml of ethyl acetate at about 60° C. to prepare a uniform solution. To this solution, 60 g of a 10% aqueous solution of lime-processed gelatin and 9 ml of a 5% aqueous solution of surface active agent (3)* were mixed with stirring and dispersed in a homogenizer at 10000 rpm for 10 minutes.

The dye fixing material was prepared in the following manner.

A polyethylene-laminated paper support was coated with the following layers to prepare a dye fixing material R-1.

Structure of dye fixing material R-1

| No. | Additive | Amount ($g/m^2$) |
|---|---|---|
| Third layer | gelatin | 0.05 |
| | silicone oil (1) | 0.04 |
| | surface active agent (1) | 0.001 |
| | surface active agent (2) | 0.02 |
| | surface active agent (3) | 0.10 |
| | matting agent (1) | 0.02 |
| | picolinic acid guanidine | 0.45 |
| | water-soluble polymer (1) | 0.24 |
| Second layer | mordant (1) | 2.35 |
| | water-soluble polymer (1) | 0.20 |
| | gelatin | 1.40 |

-continued

Structure of dye fixing material R-1

| No. | Additive | Amount ($g/m^2$) |
|---|---|---|
| | water-soluble polymer (2) | 0.60 |
| | high-boiling solvent (1) | 1.40 |
| | picolinic acid guanidine | 2.25 |
| | brightening agent (1) | 0.05 |
| Second layer | surface active agent (5) | 0.15 |
| First layer | gelatin | 0.05 |
| | surface active agent (3) | 0.01 |
| | water-soluble polymer (1) | 0.04 |
| | hardening agent (1) | 0.30 |
| | Support (1) | |
| First back layer | gelatin | 3.25 |
| | hardening agent (1) | 0.25 |
| Second back layer | gelatin | 0.44 |
| | silicone oil (1) | 0.08 |
| | surface active agent (4) | 0.04 |
| | surface active agent (5) | 0.01 |
| | matting agent (2) | 0.03 |

Structure of support (1)

| Layer | Composition | Layer thickness (μm) |
|---|---|---|
| Surface subbing layer | gelatin | 0.1 |
| Surface PE layer (glossy) | low-density polyethylene: 89.2 parts (density: 0.923) surface-treated titanium oxide: 10.0 parts ultramarine: 0.8 part | 45.0 |
| Pulp layer | best quality paper (LBKP/NBKP = 1:1, density: 1.080) | 92.6 |
| Back PE layer (matte) | high-density polyethylene (density: 0.960) | 36.0 |
| Back subbing layer | gelatin | 0.05 |
| | colloidal silica | 0.05 |
| | Total | 173.8 |

Silicone oil (1)

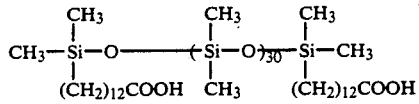

Surface active agent (1)

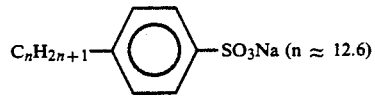

Surface active agent (2)

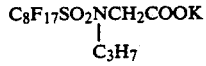

Surface active agent (3)

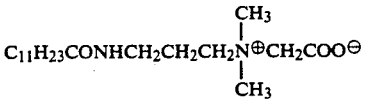

Surface active agent (4)

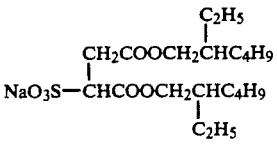

Brightening agent (1) 2,5-Bis(5-t-butylbenzoxazolyl (2)) thiophene

Surface active agent (5)

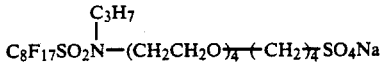

-continued

| | |
|---|---|
| Water-soluble polymer (1) | Sumikagel L5-H (a product of Sumitomo Chemical Co., Ltd.) |
| Water-soluble polymer (2) | Dextran (MW = 70,000) |
| Mordant (1) | 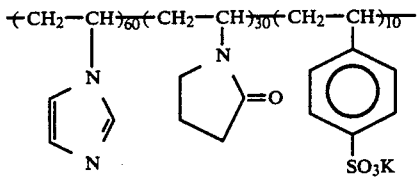 |
| High-boiling solvent (1) | 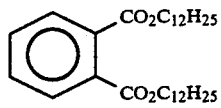 |
| Hardening agent (1) | 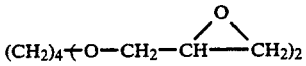 |
| Matting agent (1) | Silica |
| Matting agent (2) | Benzoguanamine resin (average particle size: 15 μm) |

The obtained multi-layer color light-sensitive materials 101 to 105 were exposed through B, G, R and grey color separation filters (density being continuously changed) at 500 lux for one second by using a tungsten lamp.

Water at a rate of 15 ml/m$^2$ was added to the surface of the emulsion of each of the exposed light-sensitive materials by means of a wire bar, and the surface of the emulsion and the dye fixing material were then placed on each other so as to be brought into close contact with each other.

The laminate was heated for 15 seconds by using a heated roller whose temperature was controlled so that the temperature of the layer absorbed water became 80° C. The light-sensitive material was peeled off from the dye fixing material. On the dye fixing material, clear blue, green, red and grey images corresponding to the B, G, R and grey color separation filters were obtained.

Maximum density ($D_{max}$) and minimum density ($D_{min}$) of each of cyan, magenta and yellow colors in the grey area were measured. The results are shown in Table 2.

In another experiment, these light-sensitive materials 101 to 105 were stored for 7 days under such conditions that the temperature was 45° C. and relative humidity was 70%. These materials were then processed in the same manner as that described above. The results are also shown in Table 2.

used, images having a high density and a low degree of stain were obtained and preservability was improved.

EXAMPLE 2

Light-sensitive materials 201 to 205 were prepared in the same way as in the preparation of the light-sensitive materials 101 to 105 of Example 1 except that the reducing agent (1)* added to the intermediate layers comprising the second layer and the fourth layers was omitted.

The same compound used for the electron donor used in the first, third and fifth layers of the light-sensitive materials 201 to 205 in an amount of twice as much by mol as the reducing agent (1)* of the light-sensitive material 101, was added to each of the intermediate layers comprising the second and fourth layers of the light-sensitive materials 201 to 205 to prepare light-sensitive materials 301 to 305.

The light-sensitive materials 201 to 205 and 301 to 305 were exposed through a wedge whose density was continuously changed in the direction perpendicular to wavelength by using a spectrograph. The light-sensitive materials were processed in the same way as in Example 1 by using the dye fixing material of Example 1. All of the light-sensitive materials 201 to 205 showed insufficient color reproduction while all of the light-sensitive materials 301 to 305 showed good color reproduction.

Further, the light-sensitive materials 201 to 205 and 301 to 305 were stored under the conditions of 45° C.

TABLE 2

| Light-sensitive material No. | Reducing agent (Electron donor No. | Immediately after preparation | | | | | | After storage at 45° C. and 70% for one week | | | | | |
|---|---|---|---|---|---|---|---|---|---|---|---|---|---|
| | | $D_{min}$ | | | $D_{max}$ | | | $D_{min}$ | | | $D_{max}$ | | |
| | | Yellow | Magenta | Cyan | Yellow | Magenta | Cyan | Yellow | Magenta | Cyan | Yellow | Magenta | Cyan |
| 101 | Comp. Ex. | 0.17 | 0.18 | 0.14 | 2.0 | 2.1 | 2.1 | 0.42 | 0.40 | 0.35 | 2.0 | 2.1 | 2.1 |
| 102 | (6) | 0.15 | 0.16 | 0.13 | 2.0 | 2.1 | 2.1 | 0.19 | 0.19 | 0.17 | 2.1 | 2.2 | 2.0 |
| 103 | (13) | 0.14 | 0.16 | 0.12 | 2.1 | 2.2 | 2.2 | 0.17 | 0.19 | 0.15 | 2.1 | 2.2 | 2.2 |
| 104 | (32) | 0.15 | 0.17 | 0.13 | 2.0 | 2.1 | 2.1 | 0.19 | 0.20 | 0.16 | 2.1 | 2.1 | 2.1 |
| 105 | (38) | 0.14 | 0.17 | 0.13 | 2.0 | 2.1 | 2.2 | 0.18 | 0.20 | 0.17 | 2.0 | 2.0 | 2.1 |

From Table 2, it can be seen that when the reducing agents (electron donors) of the present invention were and 70% RH for one weak. Photographic characteristics after storage were compared with those immediately after preparation. The light-sensitive materials 201 and 301 showed a remarkable increase in $D_{min}$, while the other light-sensitive materials scarcely changed in photographic characteristics.

It was found that when the reducing agents (electron donors) of the present invention were used in the intermediate layers, the light-sensitive material having improved color reproducibility and excellent preservability could be obtained.

EXAMPLE 3

A multi-layer color light-sensitive material 401 having a structure given in Table 3 was prepared by using the same emulsions, dye providing compounds, electron donor and electron transferring agent as those used in the light-sensitive material 101 of Example 1.

The same additives as those used in the material 101 were used unless otherwise stated.

The organic silver salt emulsion was prepared in the following manner.

20 g of gelatin and 5.9 g of 4-acetylaminophenylpropiolic acid were dissolved in 1000 ml of an aqueous solution of 0.1% sodium hydroxide and 200 ml of ethanol. The resulting solution was kept at 40° C. and stirred. A solution of 4.5 g of silver nitrate dissolved in 200 ml of water was added to the solution over a period of 5 minutes. An excess amount of salt was removed by precipitation method. The pH thereof was adjusted to 6.3 to obtain 300 g of an organic silver salt dispersion.

The anti-fogging agent precursor (1)* having the structure set forth later in an amount of 0.2 times by mol that of the dye providing compound was added and together with the dye providing compound and the electron donor was dispersed in the oil in the same way as in Example 1.

TABLE 3

| Layer No. | Layer | Additive | Amount ($g/m^2$) |
|---|---|---|---|
| Sixth layer | protective layer | gelatin | 0.91 |
| | | Matting agent (silica) | 0.03 |
| | | surface active agent (1)* | 0.06 |
| | | surface active agent (2)* | 0.13 |
| | | hardening agent (1)* | 0.01 |
| | | base precursor (1)* | 0.30 |
| Fifth layer | blue-sensitive layer | emulsion (III) (in terms of silver) | 0.30 |
| | | organic silver salt emulsion (in terms of silver) | 0.25 |
| | | gelatin | 1.00 |
| | | anti-fogging agent precursor (1)* | 0.07 |
| | | yellow dye providing compound (1)* | 0.50 |
| | | high-boiling organic solvent (1)* | 0.75 |
| | | electron donor (1)* | 0.35 |
| | | surface active agent (3)* | 0.05 |
| Fifth layer | blue-sensitive layer | electron transferring agent (1)* | 0.04 |
| | | electron transferring agent precursor (1)* | 0.02 |
| | | heat solvent (1)* | 0.20 |
| | | hardening agent (1)* | 0.01 |
| | | base precursor (1)* | 0.27 |
| | | water-soluble polymer (1)* | 0.02 |
| Fourth layer | intermediate layer | gelatin | 0.75 |
| | | reducing agent (1)* | 0.24 |
| | | high-boiling organic solvent (1)* | 0.12 |
| | | surface active agent (1)* | 0.02 |
| | | surface active agent (4)* | 0.07 |
| | | water-soluble polymer (1)* | 0.02 |
| | | hardening agent (1)* | 0.01 |
| | | base precursor (1)* | 0.25 |
| Third layer | green-sensitive layer | emulsion (II) (in terms of silver) | 0.20 |
| Third layer | green-sensitive layer | orgainc silver salt emulsion (in terms of silver) | 0.20 |
| | | gelatin | 0.85 |
| | | anti-fogging agent precursor (1)* | 0.04 |
| | | magenta dye providing compound (2)* | 0.37 |
| | | high-boiling organic solvent (1)* | 0.55 |
| | | electron donor (1)* | 0.20 |
| | | surface active agent (3)* | 0.04 |
| | | electron transferring agent (1)* | 0.04 |
| | | electron transferring agent precursor (1)* | 0.02 |
| | | heat solvent (1)* | 0.16 |
| | | hardening agent (1)* | 0.01 |
| | | base precursor (1)* | 0.25 |
| | | water-soluble polymer (1)* | 0.02 |
| Second layer | intermediate layer | gelatin | 0.80 |
| | | reducing agent (1)* | 0.24 |
| Second layer | intermediate layer | high-boiling organic solvent (1)* | 0.12 |
| | | surface active agent (1)* | 0.06 |
| | | surface active agent (4)* | 0.10 |
| | | water-soluble polymer (1)* | 0.03 |
| | | base precursor (1)* | 0.25 |
| | | hardening agent (1)* | 0.01 |
| First layer | red-sensitive layer | emulsion (I) (in terms of silver) | 0.20 |
| | | organic silver salt emulsion (in terms of silver) | 0.20 |
| | | gelatin | 0.85 |
| | | anti-fogging agent precursor (1)* | 0.04 |
| | | heat solvent (1)* | 0.16 |
| | | base precursor (1)* | 0.16 |
| | | cyan dye providing compound (3)* | 0.40 |
| | | high-boiling organic solvent (1)* | 0.60 |
| | | electron donor (1)* | 0.20 |

TABLE 3-continued

| | | | |
|---|---|---|---|
| First layer | red-sensitive layer | surface active agent (3)* | 0.04 |
| | | electron transferring agent (1)* | 0.04 |
| | | electron transferring agent precursor (1)* | 0.02 |
| | | hardening agent (1)* | 0.01 |
| | | water-soluble polymer (1)* | 0.02 |
| | Support (polyethylene terphthalate of 100 μm in thickness) | | |
| | Back layer | carbon black | 0.44 |
| | | polyester | 0.30 |
| | | polyvinyl chloride | 0.30 |
| Anti-fogging agent precursor (1)* | | 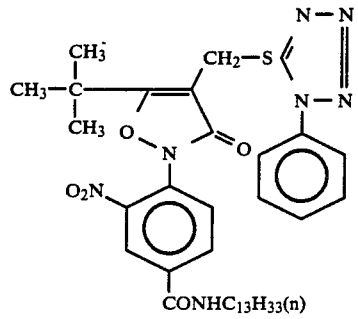 | |
| Heat solvent (1)* | | Benzenesulfonamide | |
| Base precursor (1)* | | Guanidine 4-chlorophenylsulfonylacetate | |

Light-sensitive materials 402 and 403 were prepared in the same way as in the preparation of the light-sensitive material 401 except that an equimolar amount of the compound (1) or (13) of the present invention was used in place of the electron donor (1)* used in the first, third and fifth layers of the light-sensitive material 401.

The dye fixing material (R-2) was prepared in the following manner.

10 g of poly(methyl acrylate/N,N,N-trimethyl-N-vinylbenzylammonium chloride) (the ration of methyl acrylate to vinylbenzylammonium chloride being 1:1) was dissolved in 200 ml of water. The resulting solution was uniformly mixed with 100 g of 10% lime-processed gelatin. A hardening agent was added to the mixed solution. A paper support laminated with polyethylene containing titanium dioxide dispersed therein was uniformly coated with the mixed solution in such an amount as to give a wet thickness of 90 μm. The sample was dried and used as the dye fixing material (R-2) having a mordant layer.

The light-sensitive material was exposed in the same way as in Example 1 and uniformly heated on a block heated to 140° C. for 30 seconds.

Water at a rate of 20 ml/m$^2$ was fed to the layer side of the dye fixing material (R-2). The dye fixing material and the heated light-sensitive material were placed on each other in such a manner that the layer sides of both materials are brought into contact with each other.

They were then passed through a laminator heated to 80° C. at a linear velocity of 12 mm/sec and then peeled off of each other. A positive image on the dye fixing material was obtained.

$D_{max}$ of each of cyan, magenta and yellow colors in the grey area was measured. Further, the light-sensitive materials 401 to 403 were stored under the conditions of 45° C. and 70% RH for one week and then processed in the same way as that described above. Photographic characteristics after storage were compared with those immediately after preparation. $D_{min}$ of the light-sensitive material 401 was greatly raised in a forced test, while the photographic characteristics of the light-sensitive materials 402 and 403 were scarcely changed. It was found that when the reducing agents (electron donors) of the present invention were used, the preservability of the light-sensitive material could be improved.

EXAMPLE 4

A transparent polyethylene terephthalate support was coated with the following layers in order to prepare a light-sensitive material 501. Additives used are the same materials as those used in the light-sensitive material 101 unless otherwise stated.

(I) A dye receiving layer containing
- (a) styrene-N-vinylbenzyl-N,N,N-trihexylammonium chloride copolymer (4.0 g/m$^2$)
- (b) gelatin (4.0 g/m$^2$)
- (c) surface active agent (1)* (0.2 g/m$^2$)

(II) A white color reflecting layer containing
- (a) titanium oxide (22 g/m$^2$)
- (b) gelatin (2.2 g/m$^2$)
- (c) surface active agent (1)* (0.2 g/m$^2$)

(III) An opaque layer containing
- (a) carbon black (2.7 g/m$^2$)
- (b) gelatin (2.7 g/m$^2$)
- (c) surface active agent (2)* (0.2 g/m$^2$)

(IV) A cyan dye providing layer containing
- (a) a gelatin dispersion of cyan dye providing compound (3)* (0.33 mmol/m$^2$), electron donor (1)* (0.4 mmol/m$^2$) and high-boiling organic solvent (1)* (200 mg/m$^2$)
- (b) gelatin [1.1 g/m$^2$ including the amount of gelation used in the above (a)]
- (c) surface active agent (1)* (0.20 g/m$^2$)

(V) A red-sensitive layer containing
- (a) emulsion (I) (0.5 g of Ag/m$^2$)
- (b) gelatin [1.1 g/m$^2$ including the amount of gelatin used in the above (a)]
- (c) surface active agent (1)* (0.2 g/m$^2$)

(VI) An intermediate layer containing
- (a) 2,5-di(t-pentadecyl)hydroquinone (0.82 g/m$^2$)
- (b) vinyl acetate (0.8 g/m$^2$)
- (c) gelatin (0.4 g/m$^2$)
- (d) surface active agent (1) (0.2 g/m$^2$)

(VII) A magenta dye providing layer containing
- (a) a gelatin dispersion of magenta dye providing compound (2)* (0.3 mmol/m$^2$), electron donor (1)*

(0.4 mmol/m$^2$) and high-boiling organic solvent (1)* (200 mg/m$^2$)

(b) gelatin [1.1 g/m$^2$ including the amount of gelatin used in the above (a)]

(c) surface active agent (1)* (0.2 g/m$^2$)

(VIII) A green-sensitive layer containing (a) emulsion (II) (0.5 g of Ag/m$^2$)

(b) gelatin [1.1 g/m$^2$ including the amount of gelatin used in the above (a)]

(c) surface active agent (1)* (0.2 g/m$^2$)

(IX) The same intermediate layer as (VI)

(X) A yellow dye providing layer containing (a) a gelatin dispersion of yellow dye providing compound (1)* (0.5 mmol/m$^2$), electron donor (1)* (0.6 mmol/m$^2$) and high-boiling organic solvent (1)* (250 mg/m$^2$)

(b) gelatin [1.1 g/m$^2$ including the amount of gelatin used in the above (a)]

(c) surface active agent (1)* (0.2 g/m$^2$)

(XI) A blue-sensitive layer containing (a) emulsion (III) (0.5 g/m$^2$)

(b) gelatin 1.1 g/m$^2$ including the amount of gelatin used in the above (a)]

(c) surface active agent (1)* (0.2 g/m$^2$)

(XII) A protective layer containing (a) polyethylene acrylate latex (0.9 g/m$^2$)

(b) tinuvin (0.5 g/m$^2$)

(c) hardening agent, triacryloyl perhydrotriazine (0.026 g/m$^2$)

(d) gelatin (1.3 g/m$^2$)

(e) surface active agent (1)* (0.2 g/m$^2$)

A light-sensitive material 502 was prepared in the same way as in the preparation of the light-sensitive material 501 except that an equimolar amount of the compound (5) of the present invention was used in place of the electron donor (1)* of the (IV), (VII) and (X) layers of the material 501.

A transparent polyethylene terephthalate film was coated with the following layers in order to prepare a cover sheet.

(I) An acid-neutralized layer containing (a) polyacrylic acid (17 g/m$^2$)

(b) N-hydroxysuccinimide benzenesulfonate (0.06 g/m$^2$)

(c) ethylene glycol (0.5 g/m$^2$)

(II) A timing layer coated with cellulose acetate (a degree of saponification: 54%) in a thickness of 2 μm.

(III) A timing layer coated with a copolymer latex of vinylidene chloride and acrylic acid in a thickness of 4 μm.

A processing solution having the following composition was prepared.

| | |
|---|---|
| Potassium hydroxide | 48 g |
| 4-Hydroxymethyl-4-methyl-p-tolyl-3-pyrazolidinone | 10 g |
| 5-Methylbenzenetriazole | 1.5 g |
| Sodium sulfite | 1.5 g |
| Potassium bromide | 1 g |
| Benzyl alcohol | 1.5 ml |
| Carboxymethyl cellulose | 6.1 g |
| Carbon black | 150 g |
| Water to make | 1 liter |

Each of the light-sensitive materials 501 and 502 was exposed through a wedge and placed on the cover sheet. The processing solution was uniformly spread therebetween in a thickness of 80 μm by means of a pair of parallel rollers. After one hour from the processing, sensitometry was carried out. The results are shown in the following Table.

| Light-sensitive material No. | Compound of Invention No. | $D_{max}$ | | | $D_{min}$ | | |
|---|---|---|---|---|---|---|---|
| | | Y* | M* | C* | Y* | M* | C* |
| 501 | Comp. Ex. | 2.1 | 2.2 | 2.1 | 0.18 | 0.21 | 0.20 |
| 502 | (5) | 2.1 | 2.1 | 2.2 | 0.17 | 0.18 | 0.19 |

Note:
*Y Yellow
M Magenta
C Cyan

Further, the light-sensitive materials 501 and 502 were stored under the conditions of 45° C. and 70% RH for one week and then processed in the same way as that described above. Photographic characteristics after storage were compared with those immediately after preparation. Both materials scarcely caused change in $D_{max}$ but an increase in $D_{min}$ of the light-sensitive material 502 was small in comparison with the light-sensitive material 501. Hence, it was found that when the reducing agent of the present invention was used, preservability of the light-sensitive material could be improved.

While the present invention has been described in detail and with reference to specific embodiments thereof, it is apparent to one skilled in the art that various changes and modifications can be made therein without departing from the spirit and scope of the present invention.

What is claimed is:

1. A color light-sensitive material comprising at least light-sensitive silver halide, a binder, a reducible dye providing compound and a reducing agent represented by the following general formula (I) on a support

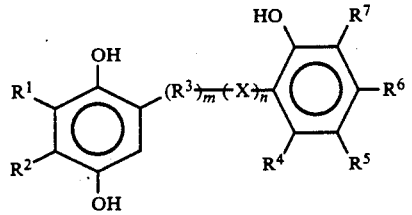

(I)

wherein $R^1$ and $R^2$ each represents a hydrogen atom, a halogen atom, a substituted or unsubstituted alkyl group, a substituted or unsubstituted aryl group, a substituted or unsubstituted acylamino group, a substituted or unsubstituted alkoxy group, a substituted or unsubstituted aryloxy group, a substituted or unsubstituted alkylthio group, a substituted or unsubstituted arylthio group, a substituted or unsubstituted acyl group, a substituted or unsubstituted sulfonyl group, a substituted or unsubstituted carbamoyl group or a substituted or unsubstituted sulfamoyl group, or $R^1$ and $R^2$ may be combined together to form a carbon ring or a heterocyclic ring; $R^3$ represents a substituted or unsubstituted alkylene group; $R^4$, $R^5$, $R^6$ and $R^7$ each represents a hydrogen atom, a halogen atom, a hydroxyl group, a cyano group, a nitro group, a substituted or unsubstituted alkyl group, a substituted or unsubstituted acylamino group, a substituted or unsubstituted sulfonamido group, a substituted or unsubstituted alkoxy group, a substituted or unsubstituted aryloxy group, a substituted or unsubstituted alkylthio group, a substituted or unsubstituted arylthio group, a substituted or unsubstituted amino group, a substituted or unsubstituted acyl group, a substituted or unsubstituted acyloxy group, a substituted or unsubstituted carbamoyl group, a substituted or unsubstituted carbamoylamino group, a substituted or unsubstituted sulfamoyl group, a substituted or unsubstituted sulfamoylamino group, a substituted or unsubstituted alkoxycarbonyl group, a substituted or unsubstituted aryloxycarbonyl group, a substituted or unsubstituted heterocyclic group, a substituted or unsubstituted aryloxycarbonyloxy group, a substituted or unsubstituted alkoxysulfonyl group or a substituted or unsubstituted aryloxysulfonyl group (with the proviso that $R^5$ is not a hydroxyl group), or two adjoining groups may be combined together to form a carbon ring or a heterocyclic ring; X represents —NHCO—, —NHCONH—, —CONH—, —$NHSO_2$—, —$NHSO_2NH$—, —$SO_2NH$— or $$-O-\overset{\overset{\displaystyle O}{\|}}{C}-;$$

m represents 1 and n represents 0 or 1; and the sum total of carbon atoms of $R^1$ to $R^7$ are not less than 8.

2. A color light-sensitive material as claimed in claim 1, wherein $R^1$ and $R^2$ each represents a hydrogen atom, a halogen atom, a substituted or unsubstituted alkyl group, a substituted or unsubstituted alkoxy group or a substituted or unsubstituted alkylthio group.

3. A color light-sensitive material as claimed in claim 2, wherein $R^1$ and $R^2$ each represents a hydrogen atom, a halogen atom or a substituted or unsubstituted alkyl group.

4. A color light-sensitive material as claimed in claim 3, wherein $R^1$ and $R^2$ each represents a substituted or unsubstituted alkyl group.

5. A color light-sensitive material as claimed in claim 1, wherein $R^3$ represents an unsubstituted or alkyl-substituted alkylene group.

6. A color light-sensitive material as claimed in claim 1, wherein $R^4$, $R^5$, $R^6$ and $R^7$ each represents a hydrogen atom, a substituted or unsubstituted alkyl group, a substituted or unsubstituted acylamino group, a substituted or unsubstituted sulfonamido group, a substituted or unsubstituted alkoxy group, a substituted or unsubstituted acyloxy group, a substituted or unsubstituted carbamoyl group, a substituted or unsubstituted sulfamoyl group, a substituted or unsubstituted alkoxycarbamoyl group or a substituted or unsubstituted alkoxysulfonyl group.

7. A color light-sensitive material as claimed in claim 6, wherein $R^4$, $R^5$, $R^6$ and $R^7$ each represents a hydrogen atom, a substituted or unsubstituted alkyl group, a substituted or unsubstituted acylamino group, a substituted or unsubstituted sulfonamido group, a substituted or unsubstituted carbamoyl group, or a substituted or unsubstituted alkoxycarbonyl group.

8. A color light-sensitive material as claimed in claim 1, wherein X represents —NHCO—.

9. A color light-sensitive material as claimed in claim 1, wherein n represents 0.

10. A color light-sensitive material as claimed in claim 1, wherein the sum total of carbon atoms of $R^1$ to $R^7$ is within the range from 10 to 30.

11. A color light-sensitive material as claimed in claim 1, wherein the reducing agent is used in an amount of 0.001 to 20 mol per mol of silver.

12. A color light-sensitive material as claimed in claim 11, wherein the reducing agent is used in an amount of 0.01 to 10 mol per mol of silver.

13. A color light-sensitive material as claimed in claim 1, wherein the reducing agent is used in an amount of 0.05 to 10 mol per mol of the reducible dye providing compound.

14. A color light-sensitive material as claimed in claim 13, wherein the reducing agent is used in an amount of 0.1 to 5 mol per mol of the reducible dye providing compound.

* * * * *